US008002157B2

(12) United States Patent
Willows et al.

(10) Patent No.: US 8,002,157 B2
(45) **Date of Patent: *Aug. 23, 2011**

(54) BOTTLE AND WAIST PACK

(76) Inventors: Keith S. Willows, Seattle, WA (US); Antonio Del Rosario, Federal Way, WA (US); June Angus, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/423,564

(22) Filed: Apr. 14, 2009

(65) Prior Publication Data

US 2009/0224012 A1 Sep. 10, 2009

Related U.S. Application Data

(63) Continuation of application No. 11/225,705, filed on Sep. 12, 2005, now Pat. No. 7,520,412, which is a continuation of application No. 10/367,199, filed on Feb. 13, 2003, now Pat. No. 6,971,562.

(60) Provisional application No. 60/356,814, filed on Feb. 13, 2002, provisional application No. 60/398,987, filed on Jul. 25, 2002.

(51) Int. Cl.
*A45F 5/00* (2006.01)

(52) U.S. Cl. ..... 224/148.4; 224/148.5; 224/148.7

(58) Field of Classification Search ..... 224/148.4, 224/148.6, 148.5, 148.7
See application file for complete search history.

(56) References Cited

U.S. PATENT DOCUMENTS

| | | | | |
|---|---|---|---|---|
| D219,954 | S | 2/1971 | Koenigsberg | |
| 4,176,772 | A | 12/1979 | Danon | |
| 4,197,890 | A | 4/1980 | Simko | |
| D257,409 | S | 10/1980 | Kishbaugh et al. | |
| D300,904 | S | 5/1989 | Pardo et al. | |
| 4,974,762 | A | 12/1990 | Boretsky et al. | |
| 4,993,565 | A | 2/1991 | Ota et al. | |
| D318,798 | S | 8/1991 | Biesecker | |
| D320,455 | S | 10/1991 | Malcolm | |
| 5,240,156 | A * | 8/1993 | Sicotte et al. | 224/583 |
| 5,301,857 | A * | 4/1994 | Green | 224/148.4 |
| 5,427,290 | A | 6/1995 | Thatcher | |
| 5,570,824 | A | 11/1996 | Lyon et al. | |
| D392,390 | S | 3/1998 | Chan et al. | |
| 5,722,574 | A | 3/1998 | Pratt | |
| D393,211 | S | 4/1998 | Mengeu | |
| 5,758,790 | A | 6/1998 | Ewing, Jr. | |
| 5,772,090 | A | 6/1998 | Rodriguez | |
| 5,873,551 | A | 2/1999 | Jones | |
| D410,770 | S | 6/1999 | Bergara | |
| 5,938,089 | A * | 8/1999 | Abreu-Marston | 224/148.5 |
| 6,003,744 | A * | 12/1999 | Culjak | 224/148.5 |
| 6,109,496 | A | 8/2000 | Andrew et al. | |
| 6,182,872 | B1 | 2/2001 | Six | |
| 6,321,958 | B1 | 11/2001 | Erdmann | |
| D458,021 | S * | 6/2002 | Willows et al. | D3/226 |

(Continued)

OTHER PUBLICATIONS

Ultimate Direction, 2002 High Performance Hydration.

(Continued)

*Primary Examiner* — Justin M Larson
(74) *Attorney, Agent, or Firm* — Black Lowe & Graham PLLC

(57) ABSTRACT

A waist pack includes a sleeve for removably retaining a bottle or other container. In accordance with various preferred aspects of the invention, the pack includes a sleeve configured to securely retain the bottle while at the same time allowing for convenient removal and replacement.

11 Claims, 16 Drawing Sheets

U.S. PATENT DOCUMENTS

| | | | | |
|---|---|---|---|---|
| 6,401,993 | B1 | 6/2002 | Andrino | |
| 6,405,912 | B2 | 6/2002 | Giannou | |
| 6,454,146 | B2 | 9/2002 | Alis | |
| D468,902 | S * | 1/2003 | Willows et al. | D3/226 |
| 6,508,391 | B2 | 1/2003 | Gilbert | |
| D483,942 | S * | 12/2003 | Willows et al. | D3/226 |
| 6,823,610 | B1 * | 11/2004 | Ashley | 36/54 |
| 6,971,562 | B2 | 12/2005 | Willows et al. | |
| 7,520,412 | B2 | 4/2009 | Willows et al. | |
| 2003/0127478 | A1 * | 7/2003 | Villarreal, Jr. | 224/251 |

OTHER PUBLICATIONS

Amphipod 2004 Catalog.

* cited by examiner

BOTTLE AND WAIST PACK

PRIORITY CLAIM

This application is a continuation of U.S. application Ser. No. 11/225,705 filed Sep. 12, 2005, which issued as U.S. Pat. No. 7,520,412 which is a continuation of U.S. application Ser. No. 10/367,199, filed Feb. 13, 2003, which issued as U.S. Pat. No. 6,971,562, which claims the benefit of prior Provisional Patent Application Nos. 60/356,814 filed on Feb. 13, 2002, and 60/398,987 filed on Jul. 25, 2002.

FIELD OF THE INVENTION

The present invention relates to a bottle, container, or fluid carrying pack, and a bottle or container, which are used to contain or carry fluids and/or personal items on one's person.

BACKGROUND OF THE INVENTION

Sport, travel and general merchandise stores commonly sell articles for holding water and hydrating fluids for use during a variety of activities to enable the user to keep one's body healthfully hydrated, ward off thirst and improve sports performance. These fluid carrying articles are used for, and during, activities from leisurely walking and everyday use to hiking and more endurance sports or activities such as running, in-line skating, triathlons and adventure racing. These articles, depending on their configuration, provide varying levels of comfort and convenience relative to the intended activity and unique/varying activity variables.

Originally, day hikers used small to large, frame-less and internal/external frame, backpacks with shoulder straps, to carry bottles of water or other containers for holding fluids in a hands-free fashion. With the increased popularity of running and fitness in the 1970's packs which included shoulder straps presented an uncomfortable means of carrying fluid bottles for activities, such as running and fitness walking, due to the chafing of the shoulder straps, bouncing, large surface area coverage trapping sweat, and general inaccessibility to fluids while in motion (without stopping to take off and open the pack). Additionally, hand carrying a water bottle becomes cumbersome, tiring on the hand, uncomfortable, may hinder competitive performance levels over longer periods of strenuous activity and generally undesirable for many.

Thereafter, to improve the "hand-free" options for carrying fluids and further address the unique hydration carrying needs of more active sports enthusiasts, waist packs with a receiving holster or outside pocket for a water bottle became available. These types of packs are similar to a basic general use fanny pack available currently at most general merchandise stores. The water bottle holding packs are similar to general use fanny packs in that they attach around one's waist with two waist straps which usually buckle in the center front of the waist and include a rear "pack" portion for holding articles, are commonly made of fabric such as denier nylon (backpack style material), which rests just above, or partially on, the buttocks. However, these active sports water bottle packs differ from the above described general use waist (fanny) packs due to the unique jostling and body movement and activity related variables and physics. With the more recent active sports water bottle carriers, the rear pack portion, which rests on or above the buttocks and sides, provide one or more vertical or partially angled mounted receiving holster(s) or bottle sleeves with an opening at the top, in which the holster and opening is sized and shaped primarily to receive or hold "sports" (round cross section sports type) water bottles. To use such a bottle holding waist pack one reaches ones arm around and pulls out the bottle, drinks and then replaces the bottle. A "sports" water bottle is commonly a semi-durable plastic round cross section type bottle often utilizing a screw or press-on cap and a pop-top nipple or the like for drinking. Water or fluid may be expressed through the opening or nipple by squeezing the bottle with one's hand or and with some by holding the bottle up side down using gravity. Many of these packs are offered and constructed to carry up to two or more standard water bottles (holding volumes of about 20 oz. of water/fluid). These pack/bottle configurations are not optimal for running and other similar jarring types of activities: with such packs both with the bottle holster vertically configured, and slanted versions which the bottle rests at roughly a 45 degree angle to one side there is considerable bouncing due to the in-optimal position of the bottle relative to the waist strap angle producing torsional movement 'about' (around) the waist strap plane causing localized chafing of the bottle onto the user's body, and poor (distant) positioning of the weight (mass) of the water relative to the user's body's center of mass resulting in bouncing, sloshing of fluid in the water bottle due to the bottle position and bottle's cross sectional geometry, and ergonomic discomfort due to lack of integration of the components relative to the user's body.

The above sports types of water bottles used in most or all of current "bottle carrying packs", which are used in most sports water bottle carriers (1-2 bottle carriers), are available from a number of companies, in various sizes (and volume), are readily available at sport shops and general merchandise stores, and are also often given as promotional or participation incentives at events such as 5 k and 10 k running races. These types of bottles are also used for a multiplicity of sports and activities, including cycling whereas they fit into a rigid bottle receiving, metal, composite or plastic, bottle "cage" located in many cases on the slanted center rod of a bicycle. Many of these bottle waist packs also have additional re-closeable pockets or space for carrying other items such as keys, money and energy snacks.

Primarily due to the need for people to carry more water while engaging in long distance and endurance sports and events, and to allow an alternative (to a bottle pack) for hands free access to water during running, biking, hiking and leisure activities, more recently, backpacks and waist packs which may hold more water (than practical with a water bottle pack) or fluid in a removable soft poly bag, bladder or reservoir internally have become available. Backpack style variations of this concept are disclosed in U.S. Pat. No. 5,427,290, to Thatcher (Jun. 27, 1995). Many of these bladder packs offer access to the fluid, contained in the bladder/bag, through a hose (commonly medical type tubing) which includes a sipping valve. The hose/tube commonly extends from the bladder over one's shoulder, conveniently, in close proximity to ones chest or mouth. The backpack style bladder packs provide for the ability to carry much more water as needed for specific high endurance activities, than is practical or comfortable with a standard sports water bottle pack, and provide an additional advantage for specific activities such as biking where removing ones hand from the bicycle handle bars is dangerous or undesirable relative to competitive performance. For long distance endurance activities where the need for larger amounts of water is necessary in such cases that fluids are not readily available and/or re-filling during the activity is not desirable or possible, these bladder backpack configurations are currently the best alternative. Although bladder packs have become smaller in size than those initially available, they are still not optimal, especially for running and sports which cause the user's body to undergo jostling or up and down movement due to discomfort associated with the size of the pack, larger sweat trapping area, chafing of shoulder straps, and the inconvenience for such sports as running to drink from the tube and difficulty with filling and keeping the bladder and tubing hygienic.

Subsequent to the bladder style backpacks, bladder style fanny or waist packs have become available such as disclosed in several. Though these bladder style waist packs generally are intended to carry less water than many bladder style backpacks, and may be used for running and the like, packs using this type of configuration present some similar and additional unique drawbacks depending upon the intended use and physics/dynamics of the activity. Including difficulty drawing the water or fluid from a reservoir resting lower (than the back) on the body, and the cleaning and filling inconveniences associated with the backpack style bladder packs.

In addition the above inventions and/or their features, heretofore known suffer from drawbacks and disadvantages in combinations in the following areas:

- Causes user discomfort through bouncing and chafing
- Lack optimal ergonomics and contouring relative to the human body
- Incorporate complex use requirements or components
- Difficulty in accessing and replacement of bottle/container while in motion
- Unreliable retainment or security of bottle in pack (falls out)
- Require additional mechanism or extra user step to secure bottle fully in pack
- Limited bottle security for a wide range of conditions
- Lack optimum physics of carrying mass/fluid on the human body
- Employ features which present obstacles to optimal athletic or general performance Limited versatility for range of uses and range of users
- Difficult to use and/or inconvenient to use
- Difficult to clean and maintain hygienically
- Poorly integrated features
- Asymmetrically weighted when in use A need has arisen, therefore, for a comfortable, easy access, attractive, convenient, versatile, and hygienic device for carrying a container of fluids, or receptacle for containing other items or substances, on one's person for a range of activities from sitting and standing to activities or uses which are more active, body-motion or movement oriented in nature which may result in movements or jostling of the entire body and/or its parts due to self powered activities such as jogging/running, or otherwise motion powered activities of a person or being such as horse back riding or motorcycle riding.

There has now been developed, and disclosed herein a new and novel device which has a number of advantages not possessed by the products of this type known to heretofore be available. A bottle, container, or fluid carrying pack, and a bottle or container embodying the principals of the invention has a pack portion with means of retaining a bottle or container portion; a means of attaching the pack portion onto a users body or other article or being; and a bottle, container or fluid carrying portion.

SUMMARY OF THE INVENTION

In accordance with the present invention a bottle, container, or fluid carrying pack, and a bottle or container embodying the principals of the invention has a pack portion with means of retaining a bottle or container portion; a means of attaching the pack portion onto a users body or other article or being; and a bottle, container or fluid carrying portion.

BRIEF DESCRIPTION OF THE DRAWINGS

Preferred and alternative embodiments of the present invention are described in detail below with reference to the following drawings.

Figure 1:
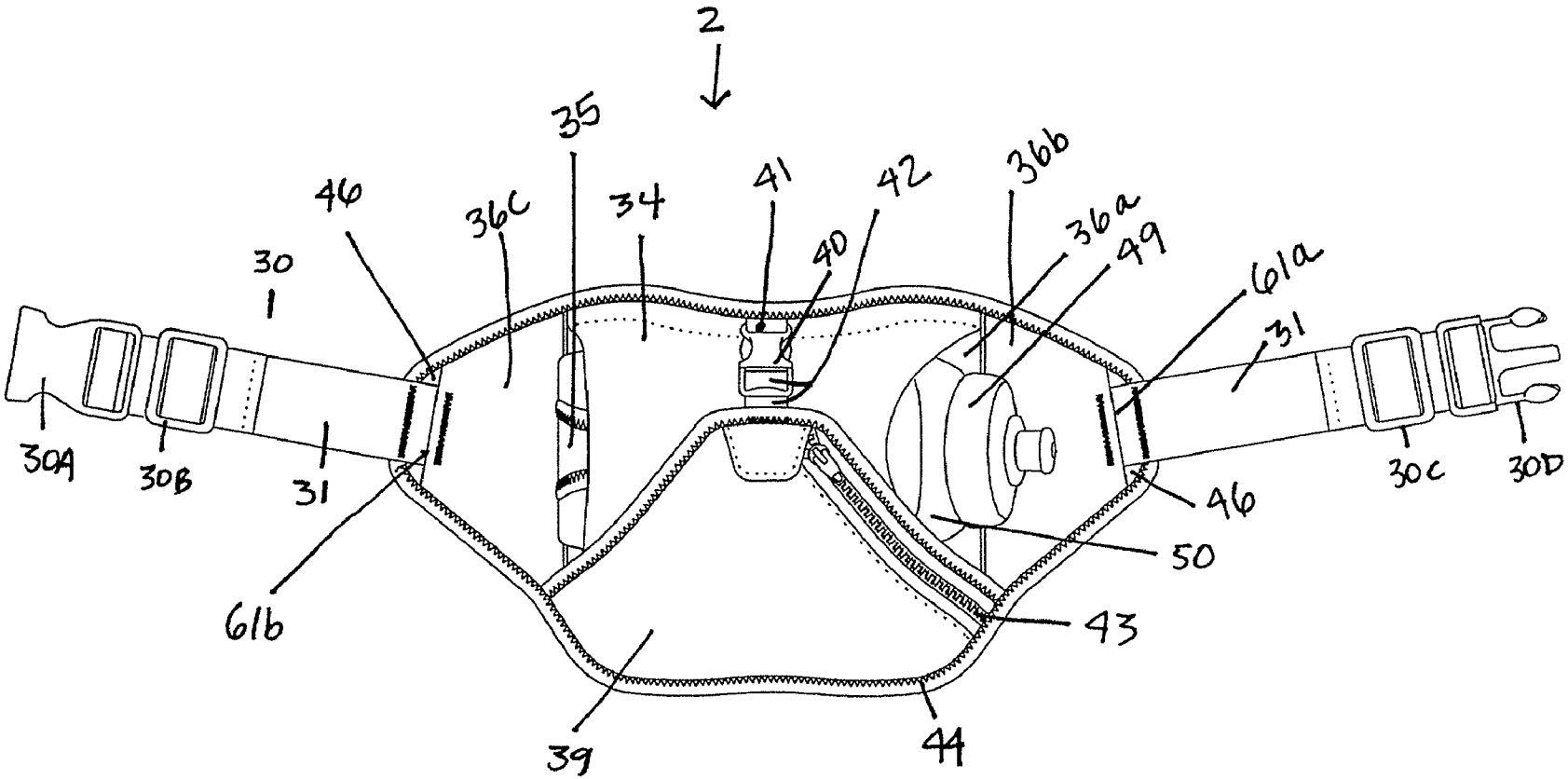
FIG. 1 shows a front view of a bottle pack with a bottle inside of the present invention.

In addition, the following reference numerals are generally used throughout the drawings and the description of the preferred embodiment below.

30 waist strap assembly
**30*a*** mating buckle
**30*b*** strap adjustment/retaining buckle
**30*c*** strap adjustment/retaining buckle
**30*d*** mating buckle
31 waist strap bands
32 pack with bottle
34 top sleeve assembly
36 retainer front panel
**36*a*** front panel portion

36*b* front panel portion
36*c* front panel portion
44 peripheral sewn edging
46 back panel
47 upper retaining sleeve border
48 lower retaining sleeve border
49 bottle top/cap
50 bottle body/reservoir
52 sub-assembled bottle retainer/sleeve
54 central hourglass bottle contour
55 bottle contour
56 bottle contour
57 bottle contour
58 bottle contour
59 bottle contour
60 pocket
61*a* waist strap pack attachment point
61*b* waist strap pack attachment point
70*a* webbing strap
70*b* webbing strap
75 mating buckle
80 bottle contour
90 central retaining band
91 foam insert
92 bottle retaining strap
93 integrated grab tab

DETAILED DESCRIPTION OF THE PREFERRED EMBODIMENT

The embodiments described herein have been contemplated for purposes of illustrating the principles of the preferred embodiments of the present invention. Accordingly, the present invention is not to be limited solely to the exact configuration and construction as illustrated and set forth herein.

FIG. 1 shows a front view of a typical preferred embodiment of the present invention. A bottle/pack (bottle and pack) 2 shown in FIG. 1 consists of two main components—a bottle carrier or pack 4, that is removably attachable to the body of the user shown independently from a front view in FIG. 2, and a bottle portion 6, shown independently from a front view in FIG. 4.

Figure 2:
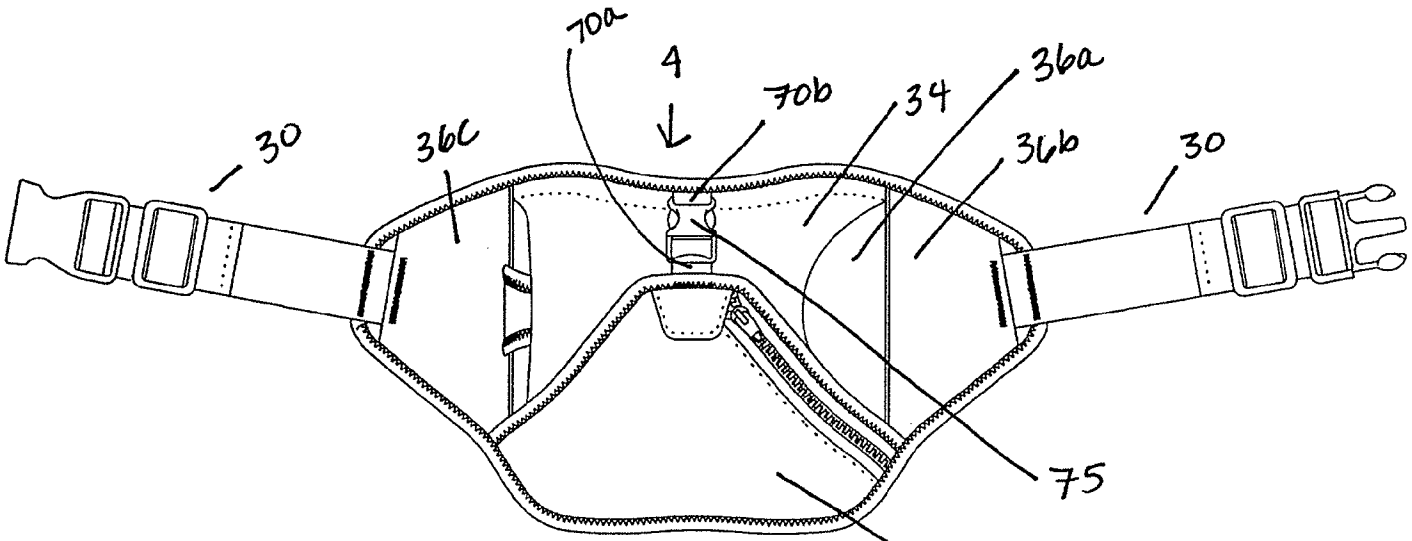
FIG. 2 shows a front view of a bottle pack of the present invention.
Figure 18:
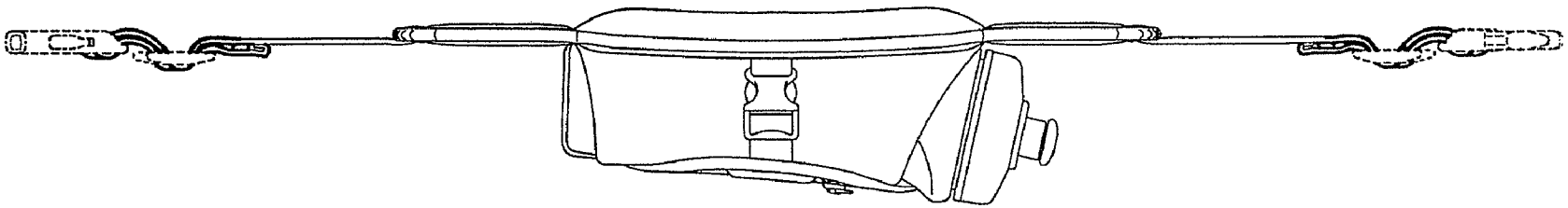
FIG. 18 shows a top view of a pack with a bottle shown in FIG. 1 of the present invention.
Figure 21:
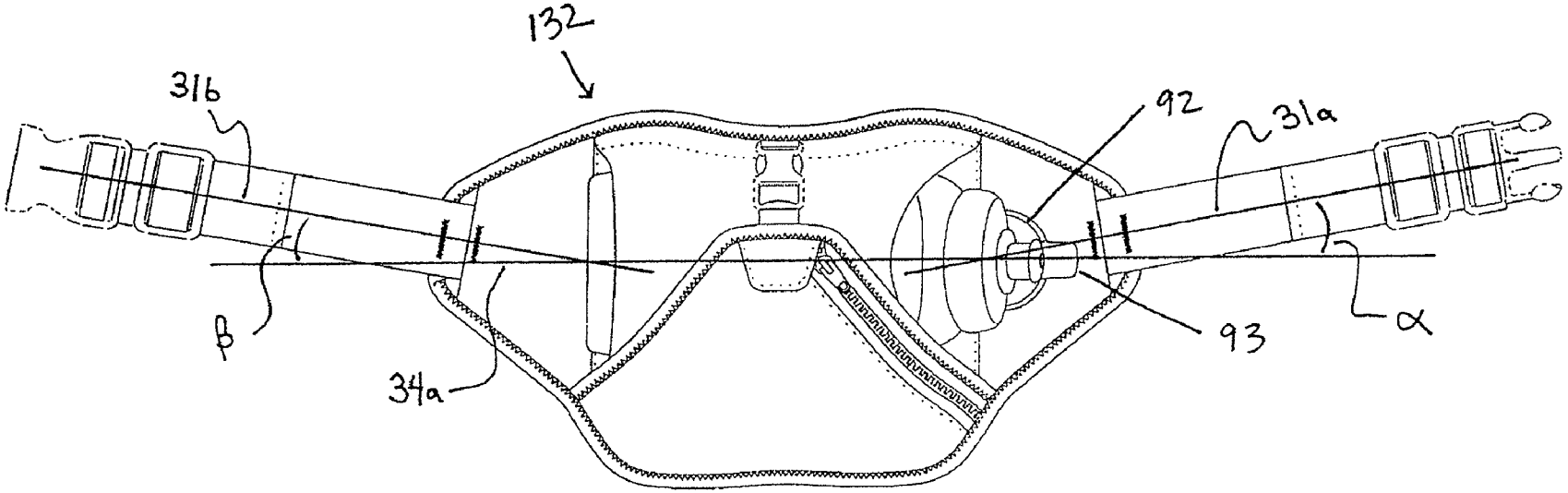
FIG. 21 shows a front view of a pack with a bottle inside with a bottle nipple retaining elastic cord with tab of the present invention.

Components of the pack portion of the invention are shown in FIG. 2—first, a main pack portion 4, which includes a bottle or container retaining sleeve 34, and body attaching means waist strap assembly 30 and its parts (waist strap bands 31, mating buckles 30A and 30D, strap adjustment/retaining buckles 30B and 30C) of FIG. 1. The buckles or other form of fastener include distal ends extending farthest from the main pack portion as illustrated in FIGS. 1 and 2. Each of the two belt sections has an overall length, as shown in FIGS. 18 and 21, extending from the open end of the sleeve to the distal end of the fastener 30A, 30D. As also shown, a portion of the waist panel beyond the open end of the sleeve may serve as part of the belt section. The pack portion of the invention is, at minimum, capable of attaching to a user's body and receiving and retaining removably and replaceably, a bottle or container. The body attaching means portion of the pack allows a pack portion 4 (FIG. 2), its parts with or without a bottle portion 6 inserted, to be removably secured to the user's body.

The bottle or container portion 6 (FIG. 4) consists of two elements—a bottle or container cap 49, and a bottle body or reservoir 50.

Figure 3:
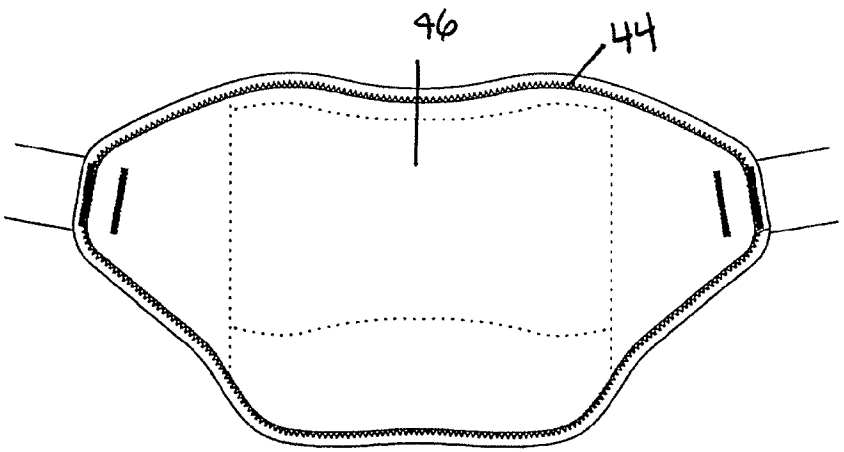
FIG. 3 shows a rear panel view of the bottle pack in FIG. 1 of the present invention.

Bottle Pack Description:

FIG. 2 is a front perspective view of the preferred embodiment of a pack portion 4, comprising a base or back panel 46 shown in a rear perspective view (FIG. 3), and a sub-assembled bottle holder sleeve portion comprised of top sleeve assembly portion 34 and a front panel portion 36, consisting of portions 36*a*, 36*b* and 36*c* in FIGS. 1 and 2. Front panel portion 36 and its parts, and a back panel 46, in FIG. 3, are of somewhat similarly shaped and sized, as to when overlaid mate providing both a main back pack panel and a main front pack panel face. Panel portion 36 may be slightly smaller at each right and left side end, as to later provide a pack body insert point for waist strap bands 31 as shown in FIG. 1. In the preferred embodiment the back panel 46 is preferably made from a soft, flexible and breathable mesh such as Drilex Aerospacer 3D padded mesh for example, or other breathable, vented mesh nylon, poly or naturally soft, light and venting material.

A sub-assembled bottle retainer or holder sleeve portion 52 (FIG. 6) is comprised of top sleeve assembly portion 34 and its front panel portion 36 (consisting of portions 36*a*, 36*b* and 36*c* in FIGS. 1 and 2) In a three part configuration for front panel 36, panel parts 36*b* and 36*c*, are preferably a vented, soft and flexible nylon mesh or the like. Preferably in this preferred configuration, front panel portion 36 is denier nylon, nylon mesh or rip-stop water proofed nylon or polyester type fabrics—durable, moisture proofed on at least one side, smooth or semi smooth and flexible. Panel parts 36*b* and 36*c* can also be combined into one piece construction with panel part 36*a*, and preferably the resulting single panel is made from denier nylon, nylon mesh or rip-stop water proofed nylon and polyester type fabrics. Desired fabrics and exact combinations of parts/material and configuration depend upon the intended use environments, performance needs, aesthetics and manufacturing considerations.

A bottle sleeve panel or portion 34 is FIG. 2, is preferably constructed of a thermal insulating material. The preferred insulating effect can be obtained using one single layer of thermal insulating material such as PE, or PU foam, or using two or three parts for to construct sleeve 34 in FIG. 2. In two parts, this is achieved by laminating a material such as nylon for the face of portion 34 to a thermally insulating fabric such as PE or PU to its backside. The same effect can be achieved from portion 34 being comprised of three layers—the outer layers in a material such as nylon or the like—and sandwiched, secured in between the two, a layer of insulating material such as types mentioned above. In multiple piece constructions, the outer layers of portion 34 are preferably made using denier nylon, nylon mesh or rip-stop water proofed nylon and polyester type fabrics which are flexible and somewhat durable.

Preferably, the size and shape of the object retaining sleeve is defined by the location of two somewhat parallel, but bowed preferably (although not necessarily) towards the center, fastening lines (47 and 48 in FIG. 6) which comprise an upper retaining sleeve border (47) and a lower retaining sleeve border (48) for example. The distance between these somewhat parallel fastening lines along the horizontal axis, fastening together panel 34 (and its sub parts) and front panel portion 36 (consisting of portions 36*a*, 36*b* and 36*c* in FIGS. 1 and 2), is preferably defined by, the necessary size and shape required, to retain and receive the desired object to be retained, such as a bottle, container or other object.

Figure 6:
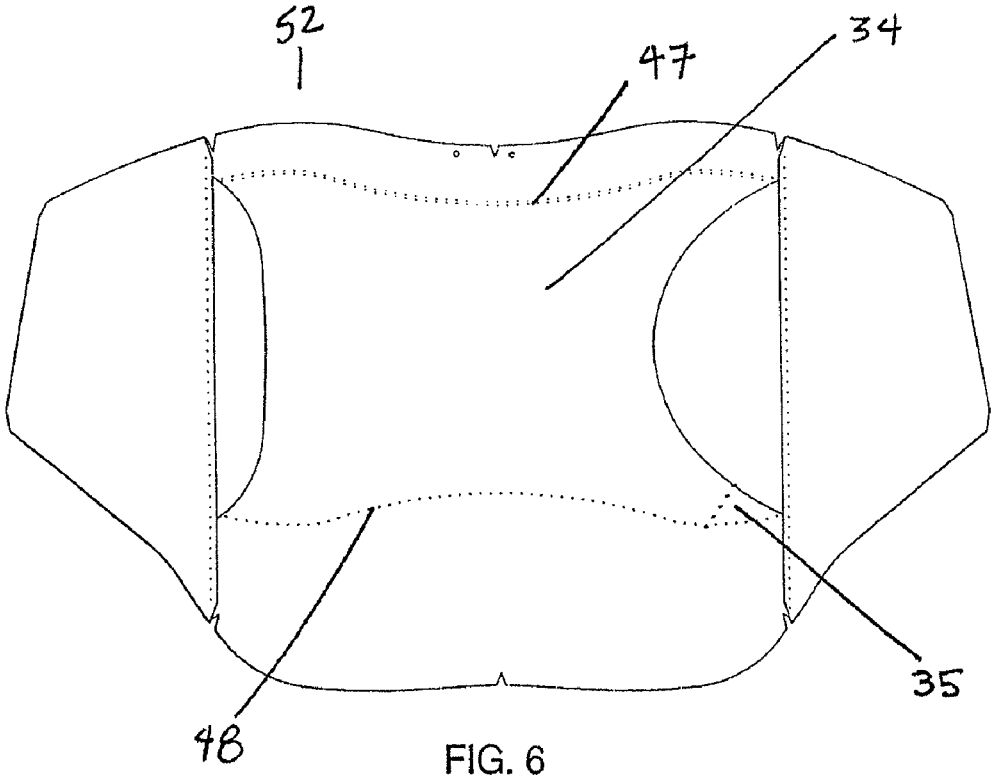
FIG. 6 shows a front view of a bottle retainer sleeve portion of the present invention.
Figure 7:
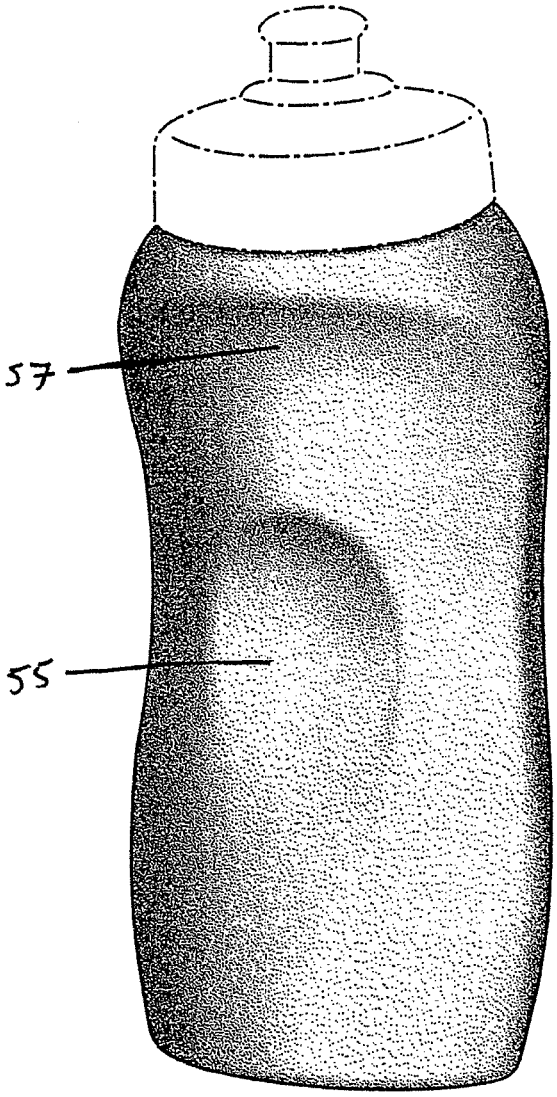
FIG. 7 shows a front ¾ view of a bottle of the present invention.
Figure 8:
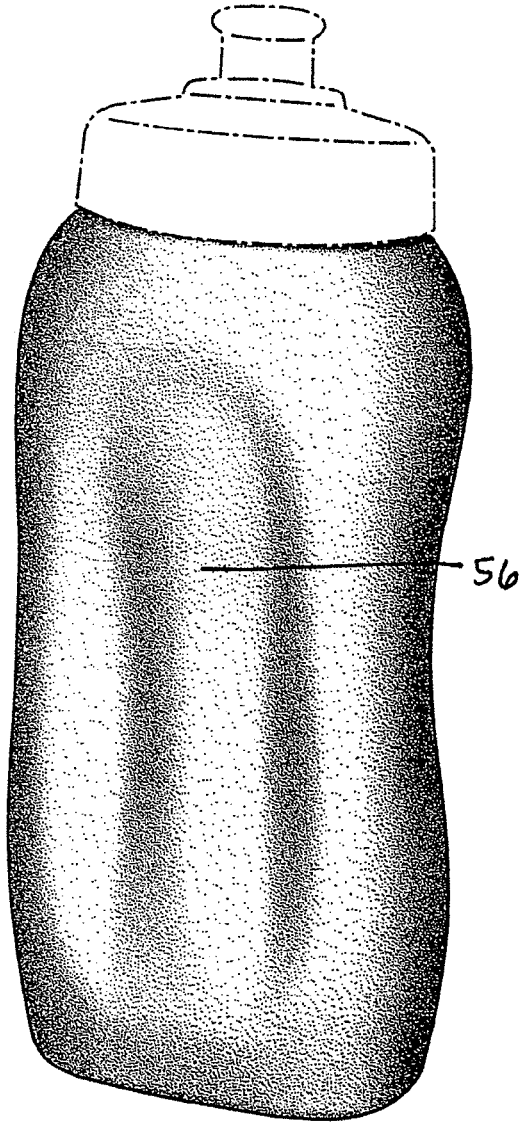
FIG. 8 shows a rear ¾ view of a bottle showing a preferred longitudinal convex contour and two longitudinal concave contour channels of the present invention.
Figure 9:
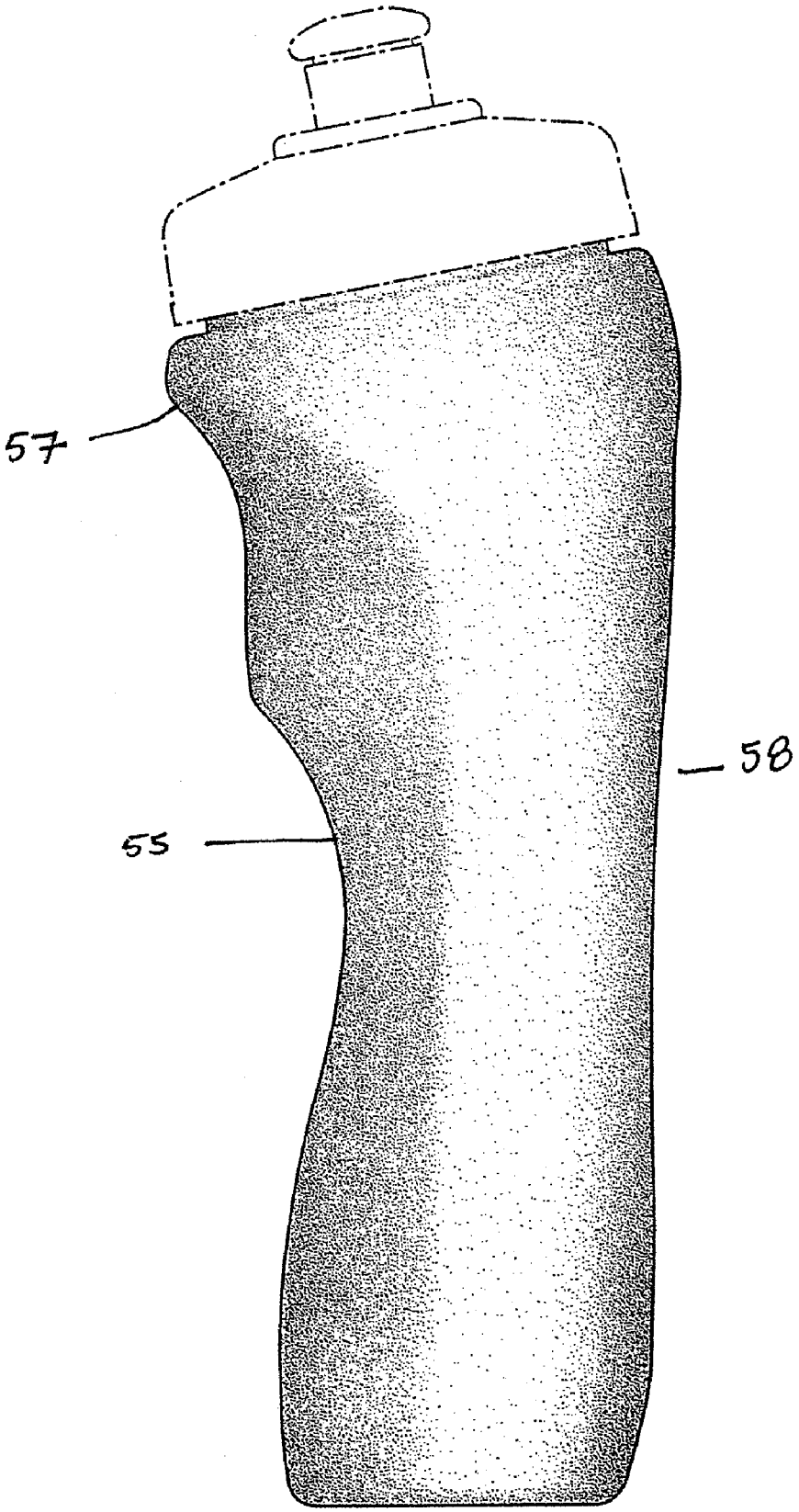
FIG. 9 shows a side view of a bottle showing a low profile contouring of the present invention.
Figure 10:
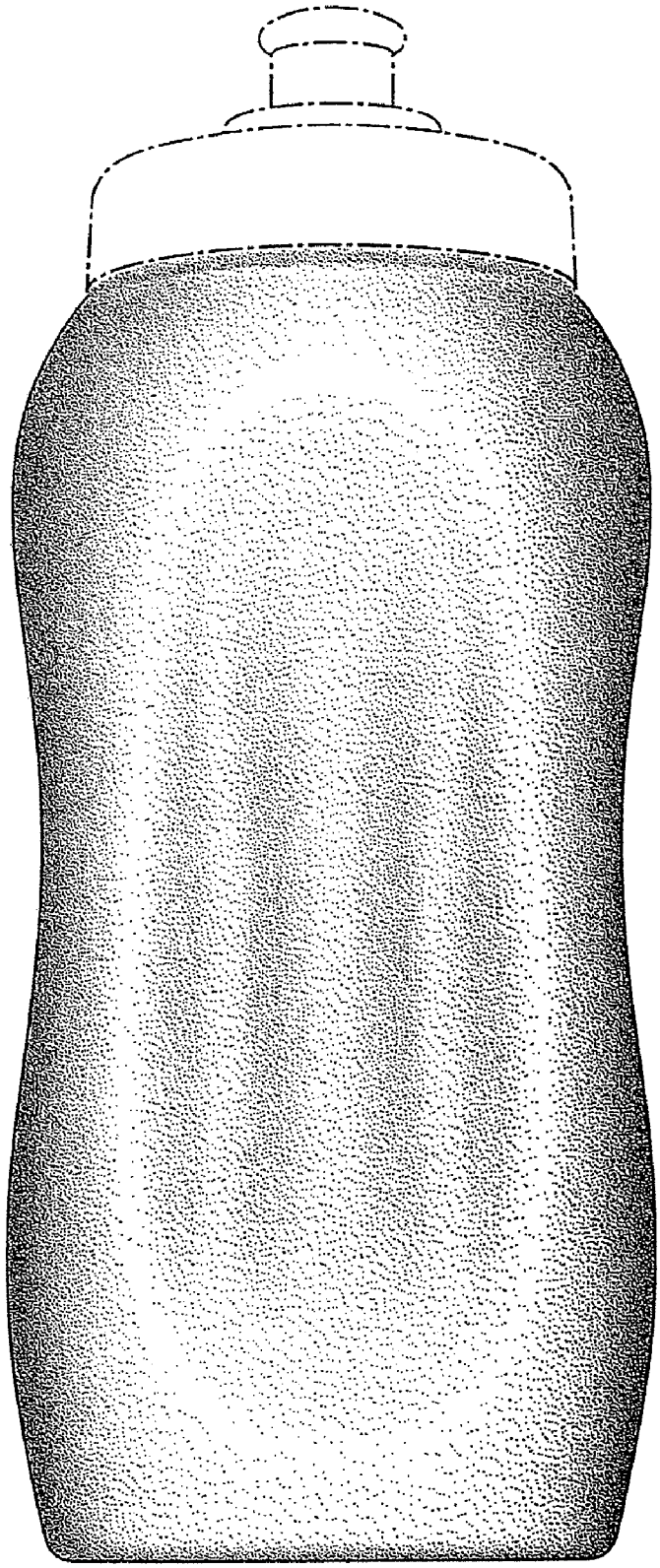
FIG. 10 shows a rear view of a bottle with two longitudinal concave contour channels of the present invention.
Figure 11:
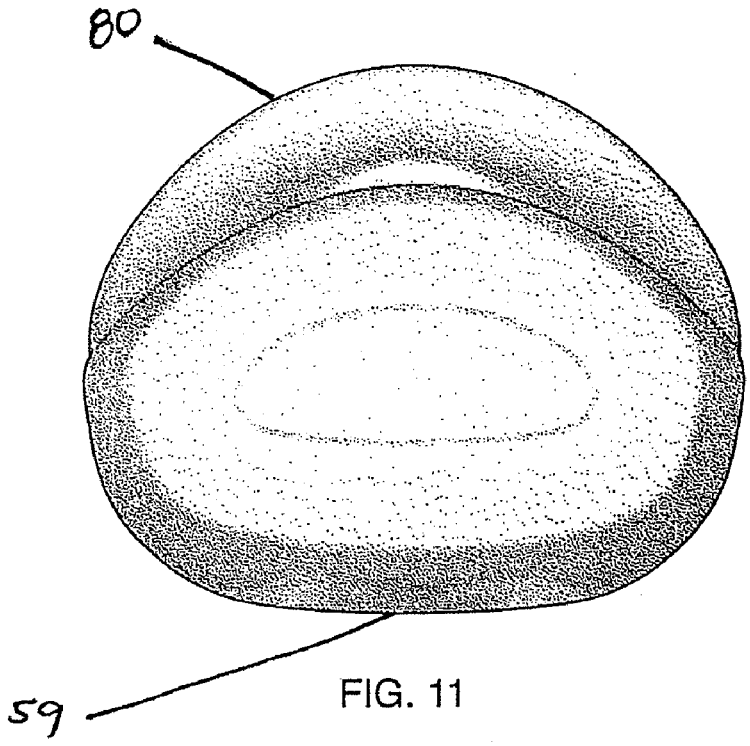
FIG. 11 shows a bottom view of a bottle of the present invention.

The sleeve may include a stitched or otherwise formed "ramp" or retaining "shoulder" 35 (see FIG. 6). This upwardly angled stitch line or boundary produces a shoulder that helps to retain the bottle within the pack during use.

Preferably, in this embodiment, panel 34 is suitably sized relative to the size of front panel portion 36 (consisting of portions 36*a*, 36*b* and 36*c* in FIGS. 1 and 2), such that when those two panels are fastened together at the upper sleeve border (47, FIG. 6) and lower sleeve border (47, FIG. 6), a bowing outward of panel 34 away from the substantially flat front panel portion 36 (consisting of portions 36*a*, 36*b* and 36*c* in FIGS. 1 and 2) results. This geometry results in a somewhat tubular (preferably, although not necessarily, somewhat semi-circular in cross section) sleeve, or bottle retaining element, of these parts combined.

One specific geometric element that is especially novel and useful in the disclosed invention is the way the bottle is held securely in the pack. One consideration for a pack that is to carry a bottle in a somewhat horizontal position on the body (the bottle's long axis is held substantially horizontal during use as a person runs, walks, skates, bikes, etc.) is the retention and access to the bottle. If a bottle is to be carried in this position a conventional bottle pack with a simple tube shaped sleeve to hold the bottle in place is not favorable because the bottle can easily fall out under normal athletic use. Secondarily most current bottle packs available incorporate a sleeve that holds the bottle in an upright or semi-upright position on the wearer's body which makes the bottle harder to access—replace or retrieve due to the necessity to pull upward behind one's back. The novel bottle and pack solve this problem because the bottle is shaped substantially hourglass shaped and the corresponding space on the pack for holding the bottle is of a corresponding hourglass shape so that when the bottle is in the pack it is held securely there. When the bottle is removed, due to its horizontal position and other features, it can be pulled straight out to the side, which eliminates the behind the back struggle and discomfort.

In the preferred embodiment, the bottle is securably retained in a retaining sleeve 52 through means of a constricted area in the sleeve or an element thereof which provides a constricting force placed substantially upon a concave central portion of the bottle or container element. This is achieved by preferably providing a retaining environment which can be achieved through various means to aid in securably retaining the bottle inside or on the pack. One means is through the internal geometry of the bottle retaining sleeve and/or in combination with other retaining components which exert some constricting pressure or force against or around two or more sides/axis of the bottle or article to be retained. The force is exerted to suitably place pressure on the concave contours in the central portion of the bottle in directions which retain it independently, or by pushing and forcing the bottle somewhat in the direction of the user's body and/or towards one or more panels of the pack.

Figure 4:
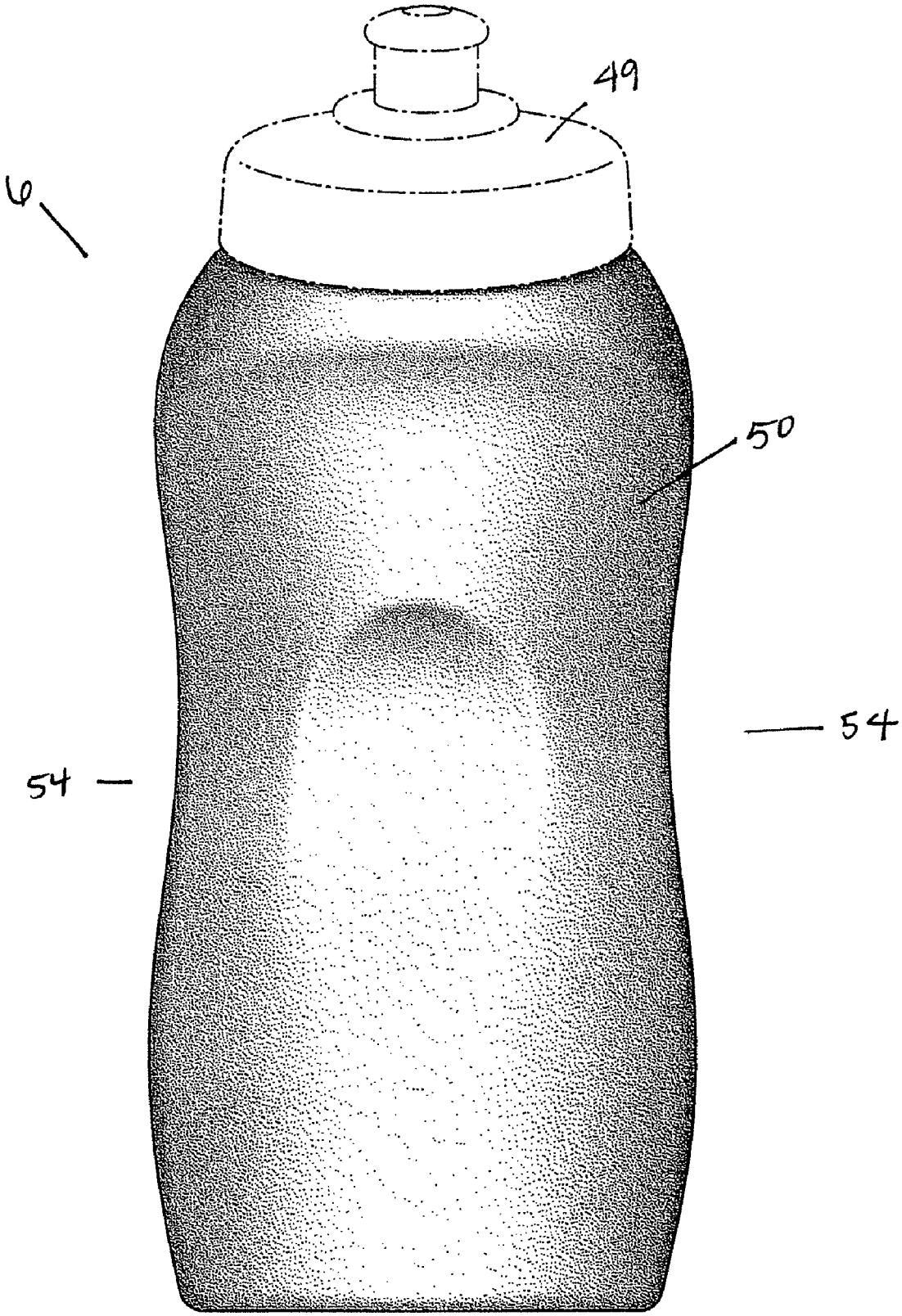
FIG. 4 shows a front view of a bottle with a cap of the present invention.
Figure 5:
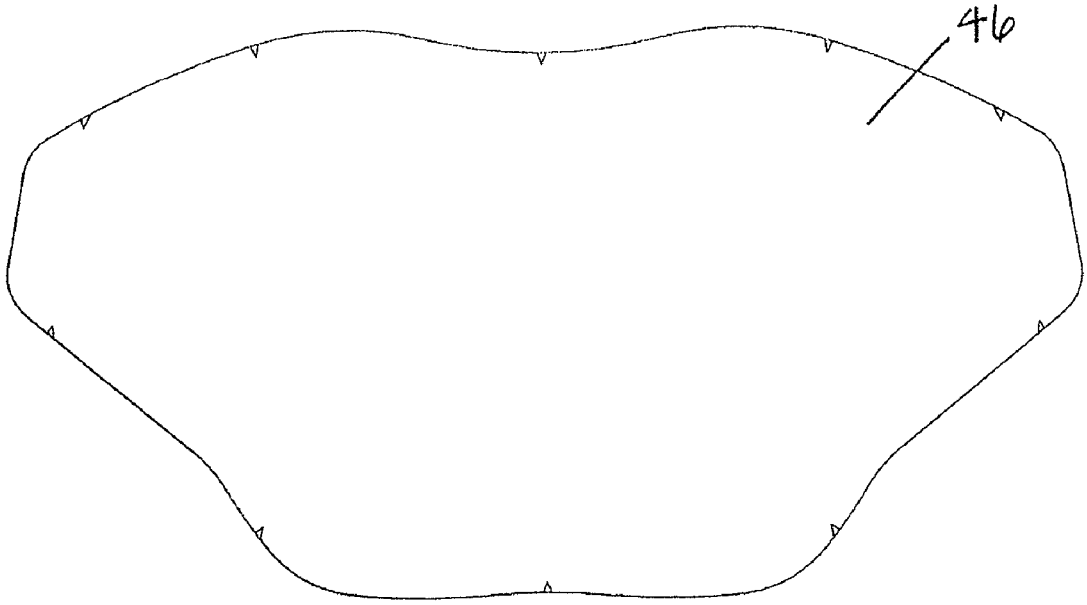
FIG. 5 shows a rear view of back panel 46 of the present invention.

One preferable method of achieving this desired constricting or retaining/holding force or pressure on the somewhat central concave contours 54, of a bottle reservoir 50 as shown in FIG. 4, is by positioning the two, fastening lines (47 and 48 in FIG. 6) such that they are somewhat closer together in their center or middle portions and somewhat further from one another at their outer ends as seen in FIG. 6, lines 47 and 48. This method creates an hourglass shaped geometry to the sleeve in which the sleeve's dimensions are somewhat smaller in the central portion (internally and visually externally) than on either and/or both ends which exerts constricting pressure on the mating concave contours around the center area of the bottle when the bottle is positioned preferably somewhat centered relative to (inside) the sleeve and its assembled parts. Alternately stated, this stitching pattern creates two cup-shaped regions, with a first cup-shaped region at the bottom of the sleeve adjacent a first opening and a second cup-shaped region at the bottom of the sleeve adjacent a second opening. FIG. 6 shows the hourglass shape resulting, on the upper and lower somewhat horizontal contoured fastening lines 47 and 48, in this configuration.

Figure 15:
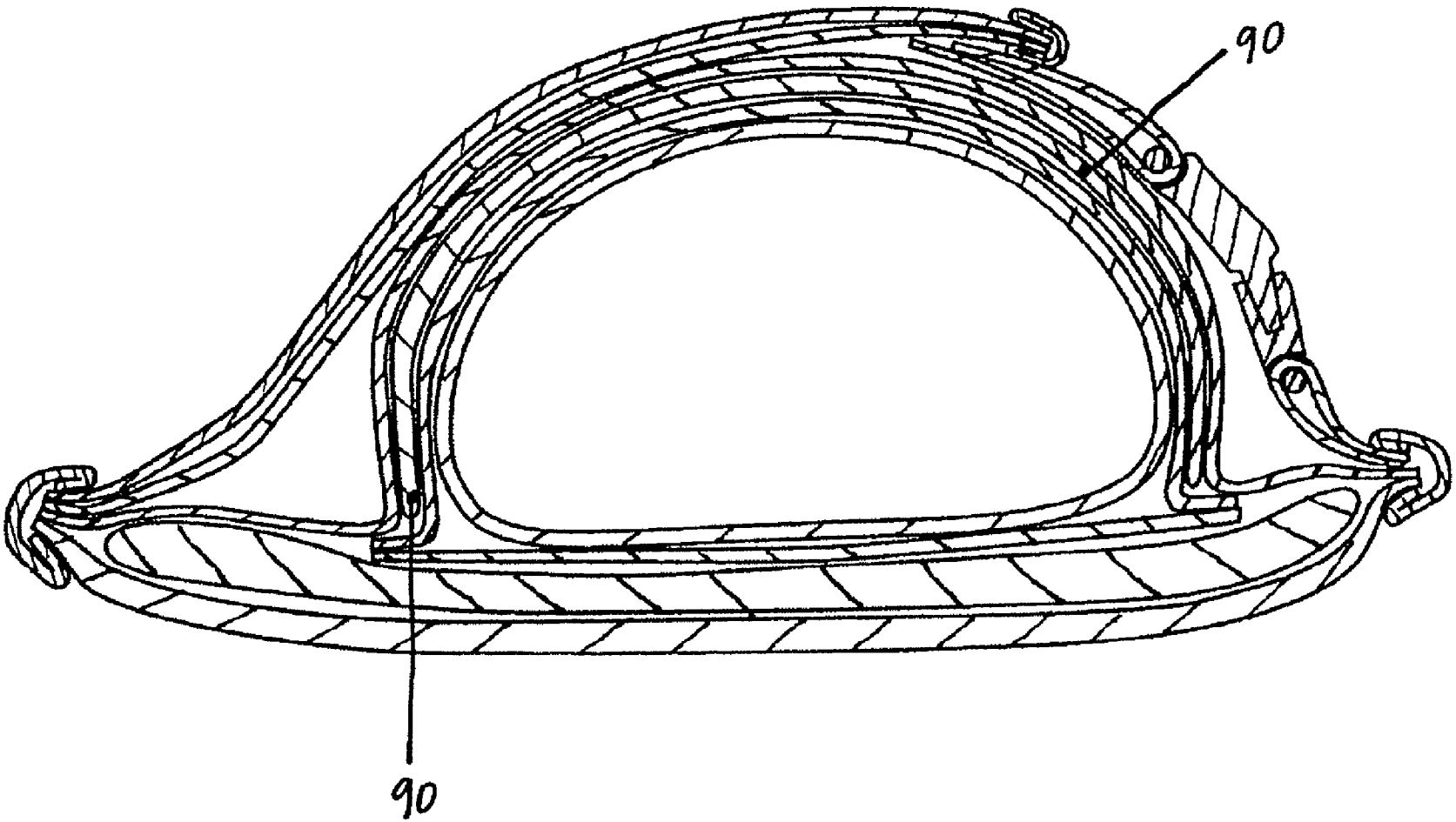
FIG. 15 Shows a cross section of a pack as shown in FIG. 1 of the present invention.
Figure 16:
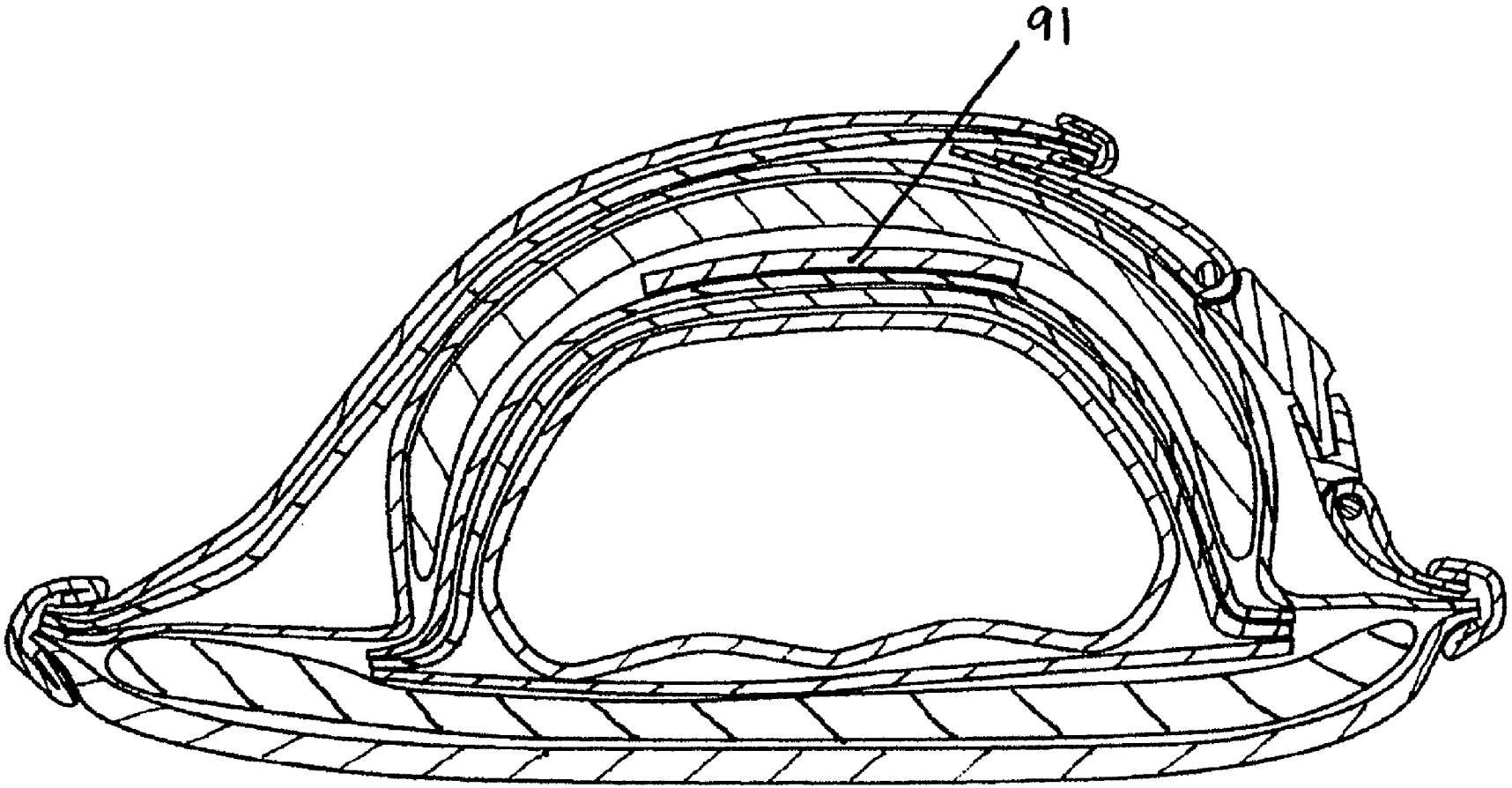
FIG. 16 Shows a cross section of a pack of the present invention.
Figure 17:
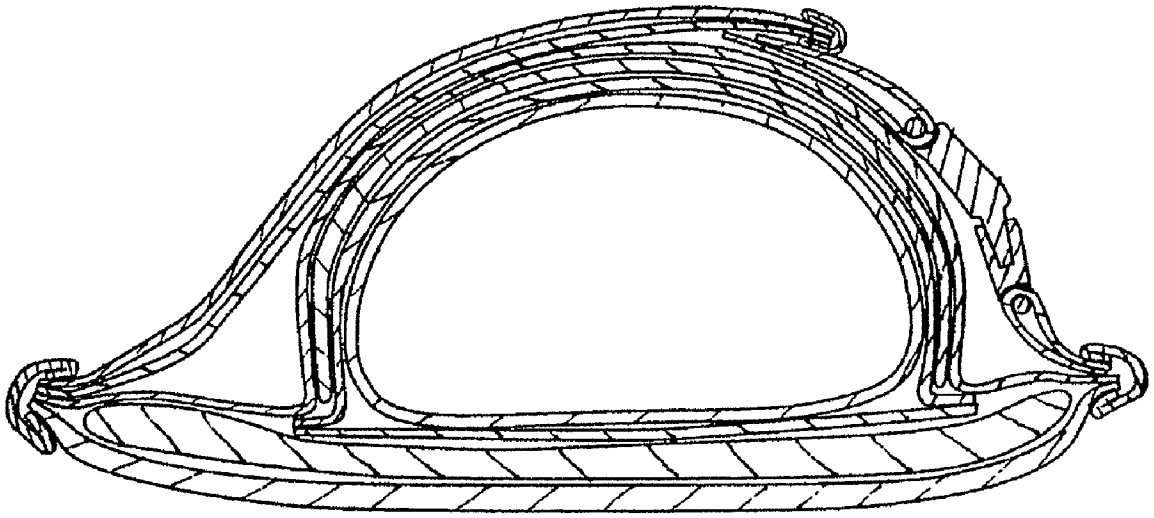
FIG. 17 Shows a cross section of a pack and a pack positioned on a user of the present invention.
Figure 17:
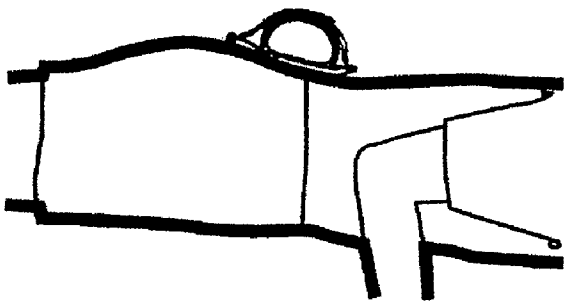

A second preferable method of achieving the desirable retaining pressure on the bottle is by using a strap, strap-like element or piece of elastic affixed at one or two points to the pack, or inside the retaining sleeve, in such a way that it wraps somewhat around one or more sides of the concave central portion of the bottle, sized and fabricated such that it exerts the desired constriction which is sized and shaped in an appropriate manner to retain the bottle in the pack and as shown as retaining band 90 in FIG. 15. A preferable manner of creating this strap or constricting element is by affixing by sewing or the like to one or more appropriately sized length(s) of stretch webbing or strap (commonly found in the stretchy waistband of clothing) somewhat centrally and positioned running vertically internal to the retaining sleeve. This strap, cord or other band or cord-like element is fastened in or in the area of the top and bottom of the hourglass-shaped fastening/sewing curves and is held fastened (sewn, glued, grouted, etc.), trapped or otherwise fixed to the inside of the retaining sleeve with an appropriately short length to provide the constriction required to hold the bottle or other bottle like element removably retained in the pack. This constricting strap is fastened to control (and reduce) the effective diameter of the central area of the bottle retaining sleeve. A thick padded and somewhat elastic foam like material (which loses and regains it shape upon pressure) patch such as a foam strip or other suitably shaped size and composition may also be utilized inside the panels of the sleeve in the central area cut suitable and sew into one or more panels to exert such bottle retaining pressure by pushing out towards the bottle (due to its thickness) creating a convex protrusion which engages or presses on the corresponding concavity in the center of the bottle. FIGS. 15 and 16 show cross-sectionally the preferred internal options to aid in bottle retainment in the sleeve. FIG. 16 shows the position and a preferable shape/size foam like insert 91, as described above.

Another consideration is access and replacement of the bottle in the pack. Because the bottle is held in a substantially horizontal position it provides for easy access and also because the bottle retaining element has a corresponding hourglass-shaped interior surface (the surfaces that contact the exterior surfaces of the bottle neck-in, in the middle) it presents a wide mouth or lead-in so that the bottle can be easily pushed back into the retaining sleeve area. This lead-in allows the user more inaccuracy in lining the bottle up with the mouth of the retaining area and so that during sports activities and general use replacing the bottle is easier without compromising the bottle's ability to lock in place and stay in the sleeve. The materials used for the bottle and/or for the corresponding substantially hourglass shaped bottle-retaining element are to be of the appropriate flexibility to allow easy removal and replacement of the bottle in bottle retaining element. There are many ways of creating this substantially hourglass-shaped bottle-retaining element. As well as ways to create the effect of a substantially hourglass shaped retaining element without it actually being hourglass shaped. For example a conventional tube shaped bottle retaining element could be used with a separate strap or other part(s) that provide the effect of necking in this central area. In the preferred embodiment this hourglass "necking-in" can be accomplished by attaching a piece of stretch strap fastened inside the bottle retaining element sleeve (see cross section diagram figure and preferred embodiment sub assemblies and final assembly of the pack). Essentially anything that provides constriction in this area can be fastened in this central area to the walls of this substantially tube shaped bottle retainer (although preferably it is smooth and fashioned in such a way that does not hang up and stop the normal use of access and/or replacement of the bottle). This feature that provides the constriction in this central area can be fastened to the inside of the bottle sleeve tube in a number of ways including sewn in place, glued, a feature could be molded to the inside of the tube, ultrasonically welded, etc. in order to provide this bottle-interlocking hourglass shape. An elastic strap may also be attached over the outside of the bottle sleeve in the middle area of the bottle, and pulled tight through a buckle to provide retaining pressure on the concave contours in the center of the bottle, however this is not preferable.

The preferred embodiment uses a strap internal to the bottle-retaining sleeve, which is of the desired length to create the desired hourglass shape. This embodiment places the strap inside the internal fabric cover of the bottle retaining element and a PE foam part is sewn in place on this elastic strap to retain the bottle in the sleeve during jarring activity such as running—the internal sleeve foam part and strap retaining elements may be used individually (strap OR foam—fastening the foam to the top inside surface of the bottle retaining sleeve) of desired tightness or thickness (however this is not preferred). This foam part provides additional locking force in a number of ways for holding in the bottle in the bottle-retaining sleeve. The preferred embodiment specifies a relatively rigid PE foam about the rigidity of what is commonly used in elbow or kneepads for sports like volleyball, also in gardening kneepads, etc. The rigidity and size/shape of this PE or PE foam-like part can be changed to a variety of desired results, increase the holding force of the bottle, to put a more directed/shaped force on a portion of the retained bottle as well as the thickness and contours of this part can be changed to get the desired bottle holding results. A thicker foam part can be used to get other over center holding-in force as this foam part compresses against the bottle sleeve foam tube as the bottle is inserted into the sleeve. The foam thickness can be adjusted so that this preferred elastic strap element does not have to be as tight to get the same bottle holding force. This is significant because both the strap's elastic and the integrated foam or foam-like element can share a portion of the force/load/stress for locking/holding the bottle in place and thus both parts are stressed individually less (there are many benefits of this—longevity/durability, manufacturing considerations, performance, etc).

Pocket(s):

As shown in the preferred embodiment of pack 4 (FIG. 2), a suitably shaped outer main pocket 60, comprised of two layers of flexible fabric sewn at their periphery with at least one recloseable opening (using a zipper, hook and loop, buttons or the like) may be affixed via sewing, grommiting, welding or molding and the like, to preferably the peripheral base of pack 4 as shown in FIG. 2 which provides for a packet itself in addition to a space created behind the pocket and using the recess provided under the bottle sleeve, such the pack base/back panel and front panel height (vertical) is greater the width of the bottle sleeve, behind the pocket panel to secure additional items. This type of pocket or additional pockets may also be affixed to the pack on other parts of the front of the pack 4 (FIG. 2) as desired, and may be layered to provide several stacked pockets to secure and hold additional personal items such as keys, money, snacks, electronics etc. Additionally, panels 36*b* and 36*c* of FIG. 2 can also be constructed with one or more recloseable openings to provide side pockets providing additional space. As shown in FIG. 2, the preferable main pocket 60 described above is attached at its center upper edge to a suitably sized webbing or strap piece 70*a* and a corresponding strap piece 70*b* (which attaches on one end to or near the top peripheral edge of mated panel 34 (FIG. 3) and 46 (FIG. 3) with a quick release mating buckle 75, providing that the area behind the pocket may be used as additional storage for a jacket, small items (which may be lodged in the space below the bottle sleeve behind the pocket and the like. When buckle 75 parts (male and female) are mated/closed the somewhat top portion of pocket 60 lays directly against the curved surface of sleeve 34. Items may be inserted somewhat directly under the upper strap and buckle portion 70*a* and 70*b* (when mated/closed) and can also be inserted, when buckle 75 is opened/unmated as mentioned above in the lower (below the protruding sleeve tube) space behind the back panel of the tautly pulled pocket as shown in FIG. 2. These strap and buckle parts are preferably made from materials as those listed above for the waist strap and buckle materials (30, and 31) in FIG. 1.

Waist Attachment:

In the preferred embodiment of the invention, the second main component of the pack portion of the invention is the body attaching means waist strap assembly 30 and its parts (waist strap bands 31, mating buckles 30A and 30D, strap adjustment/retaining buckles 30B and 30C) of FIG. 1. The pack portion of the invention is, at minimum, capable of attaching to a user's body and receiving and retaining removably and replaceably, a bottle or container. The body attaching means portion of the pack allows a pack portion 4 (FIG. 2), its parts with or without a bottle portion 6 inserted, to be removably secured to the user's body. Waist strap bands 31, as shown in FIG. 1, are preferably made of a somewhat thin and durable nylon webbing or the like. Bands 31 may also be constructed with a slightly stretchy nylon webbing. They preferably are attached or fastened to the pack via sewing, grommeting or other means at points 61*a* and 61*b* shown in FIG. 1. Both variations may include additional padding, or soft fabric such as a soft, cushioned, and absorbent Coolmax type fabric on the inside panel of the strap bands. The bands are of a length determined by the general girth at the waist or other pack attachment area of the user with extra length added on to provide a length adjustability option to the straps such that one length can be adjusted (using the adjustment parts—to follow) to increase or decreases the fit of the straps and thus the relative fit of the whole pack around one's body. Preferably at each finishing end of the straps rests a buckle male part 30*d*, and female part 30*a* (FIG. 2). These are pressed together (buckled) to provide a secure, but releasable, attachment of the two strap ends around the waist for example. Adjustment parts 30*b* and 30*c* in FIG. 2, retain extra fabric when the belt/strap is sized such that excess (smaller for example) such that excess strap length is doubled over on itself and feeds through the adjustment parts/buckles. Strap buckle parts are made preferably of hard nylon, or plastic, but can also be constructed with metal. Alternatively, the main buckle parts 30*d* and 30*a* can be replaced with hook and look, a button or fabric loop than hooks onto a metal or nylon hook and the like, to achieve the secure, but releasable closure between the waist belt ends around the user.

Straps:

Another element of the pack is the location of the straps with respect to the long axis and center of mass of the bottle. In the preferred embodiment of the disclosed invention the straps are disclosed and shown to be substantially in line with the long axis of the bottle. Not only are the straps substantially parallel to this long axis of the bottle but they are preferably as substantially and as practically as possible as close to as possible located down the center of mass of this long axis of this low-profile bottle (although offset slightly toward/next to the users body so that the pack remains as low profile and close to the users body in all respects as possible). Locating the straps in this position again minimizes the moment of inertia of the bottle with respect to the straps. This distributes the load of the bottle to the straps to the users more directly, bounces less and provides for a more comfortably worn bottle pack.

Another element of the preferred pack is the angle at which the straps or strap-like elements transition into the bottle carrying element of the pack. This angle can range from 0 (i.e., parallel, as discussed above) to 25 degrees (FIG. 21), but preferably is from 10-25 degrees which provides that the back panel of the pack is pulled more flatly and evenly against the user's body. As illustrated in FIG. 21, the belts form first and second belt axes, 31*a* and 31*b*. Likewise, the bottle defines a central horizontal axis 34*a* and a central horizontal plane that is orthogonal to the illustration of FIG. 21 and contains axis 34*a*. As shown, both the central axis 34*a* and central plane both substantially bifurcate the bottle lengthwise. The intersections of the first and second belt axes with the horizontal axis and plane form angles alpha and beta, respectively (FIG. 21). In addition, the straps are joined to the bottle carrying element, in the version shown by stitching the straps to the waist panels (as illustrated by the stitching indications in FIG. 21). The central axis 34*a* is illustrated as being parallel to a line extending from the point of connection of the first strap to the waist panel to the point of connection of the second strap to the waist panel.

In the preferred location for wearing the bottle holding element of the preferred embodiment (in the small of the user's back) the angles along with the geometry of the pack fit more closely with the human body in this area because the waist is generally smaller in diameter than the hips and thus the angles of the straps take this into account and pulls the bottle holding element of the pack more evenly against the user's waist/body.

Figure 13:
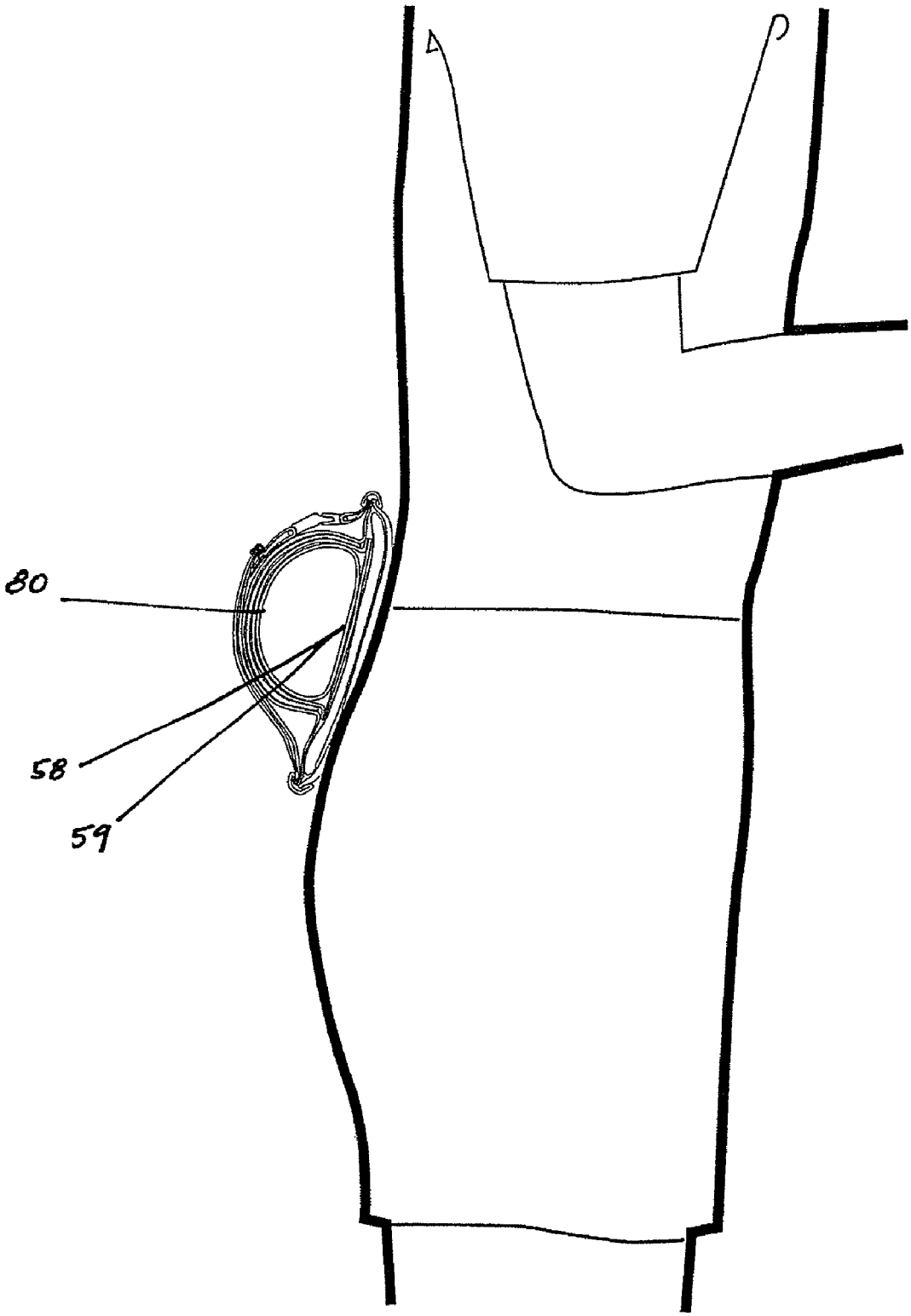
FIG. 13 shows a side view of the user wearing a pack with a bottle in cross sectional form of the present invention.
Figure 14:
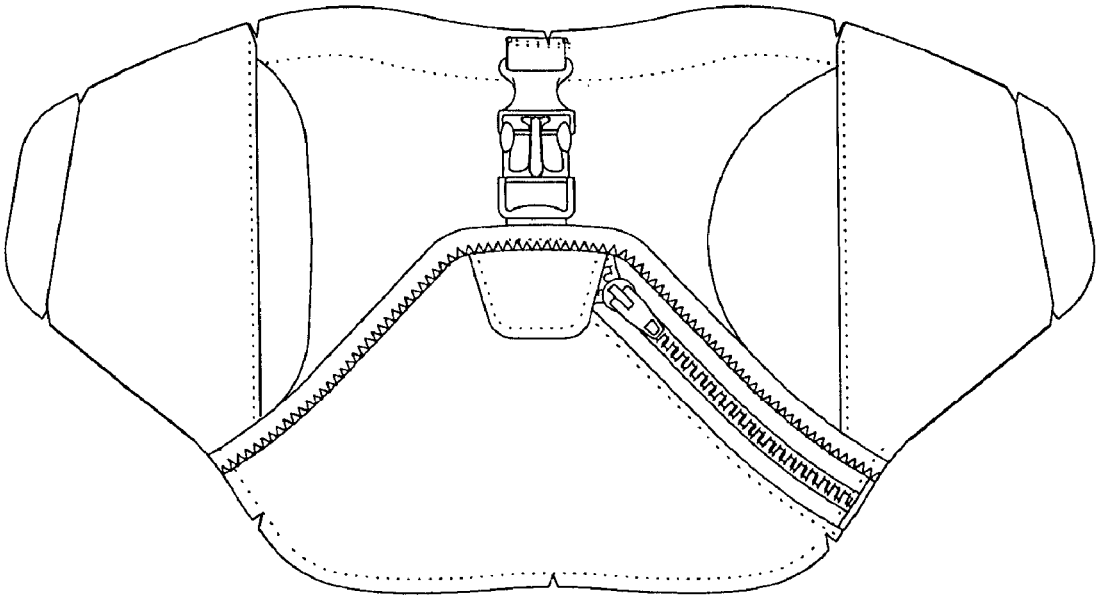
FIG. 14 shows front of a pack of the present invention without waist straps, with and without peripheral finished edging material.
Figure 14:
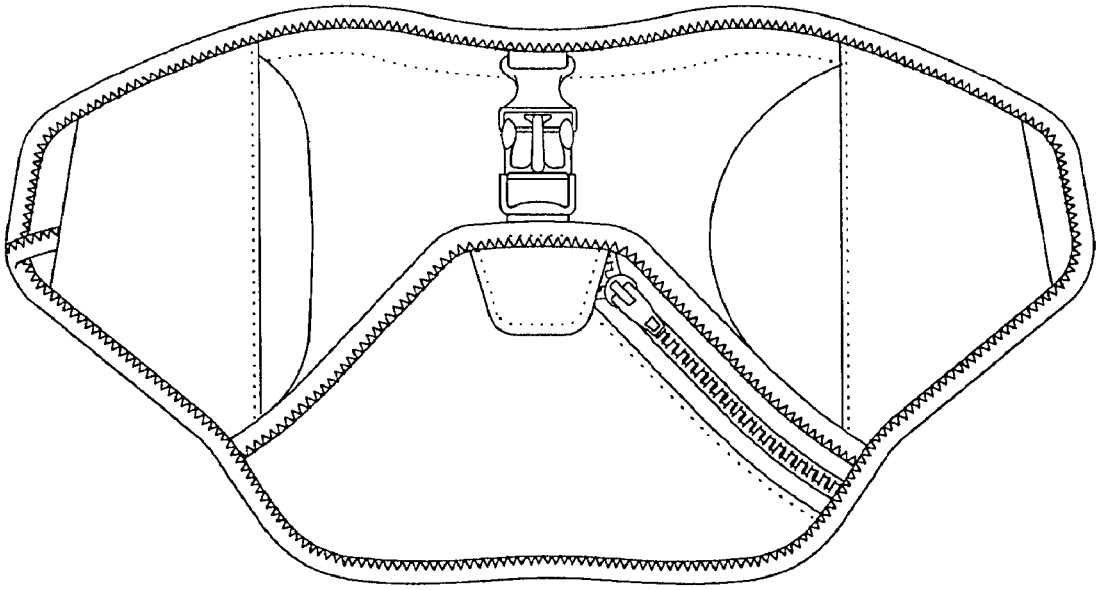

Another novel element of the disclosed invention is the geometry of the substantially lower profile bottle shape (as well as how it integrates into the lower profile pack). In other words, the bottle is shaped in such a way that it fits as close as possible to the user's body as shown in FIG. 13 from a side view. A small 7 to 40 oz (most commonly 18-25 oz) conventionally shaped sports bottle with a conventional round cross section does not fit well with the human body particularly in the small of the back (which is the preferred location for wearing the bottle holding element of the preferred embodiment). Bringing the mass of the bottle closer to the body provides for less bounce (there is less moment of inertia). The substantially oval cross-section of the bottle preferably has one axis of the cross section of the horizontal axis of the bottle substantially longer than the other (as the bottle would sit on a horizontal table with its overall longer height sitting vertical.) Another geometric consideration of the bottle is that this substantially oval or oval-like cross-section of the bottle is more flat on one of its longer (in cross-section) sides. This substantially more flat surface (looking at the overall general cross-section and ignoring some more local hand grip features in the surface) allows the bottle to sit closer to the user's body particularly in the small of the back (which is the preferred location for wearing the bottle holding element of the preferred embodiment.) Also opposite the more flat side of the cross-section can be a more rounded or convex side this allows for the bottle to hold more fluid and for the bottle to retain a more structurally strong shape (minimizes bounce as the fluid enclosed in the bottle is held more firmly in place in the bottle and the walls of the bottle flex outward less as would occur in cases where the user is engaged in a more jarring activity like running or jogging.) This shape cross-section allows for a lower profile bottle—allows for the bottle and its contents' center of mass to be brought closer to the user's body and thus reduces the overall bounce of the pack during jarring or somewhat jarring activities. Also this flattened slightly convex surface that would sit against the users back spreads the load of the bottle and weight carried in the pack much more evenly than a bottle with a generally more convex cross-section. The preferred embodiment bottle and pack surfaces more closely nest with a user's back. Spreading the load and reducing point loads makes the bottle pack much more comfortably worn against the body. Although this unique bottle geometry is preferable within the preferred pack, configured horizontally/laterally (it offers an improved design over conventional vertical and slanted bottle pack configurations) a traditionally shaped bottle could be used in this pack and function better than conventionally configured bottle packs. The disclosed pack provides the novel geometry to allow almost any traditionally shaped bottle to be carried horizontally in the small of the user's back which is a substantial improvement of comfort, ease-of-bottle access, etc. over other on-the-market bottle packs (all configured either vertically or slanted in the small of the user's back).

Beyond just the basic elements of the pack (composed of a bottle holding element and method for attaching this element to the users body/person as described and depicted in the accompanying drawings) the pack also has a number of novel optional elements, as well that add desirable features and benefits to the user.

Figure 19:
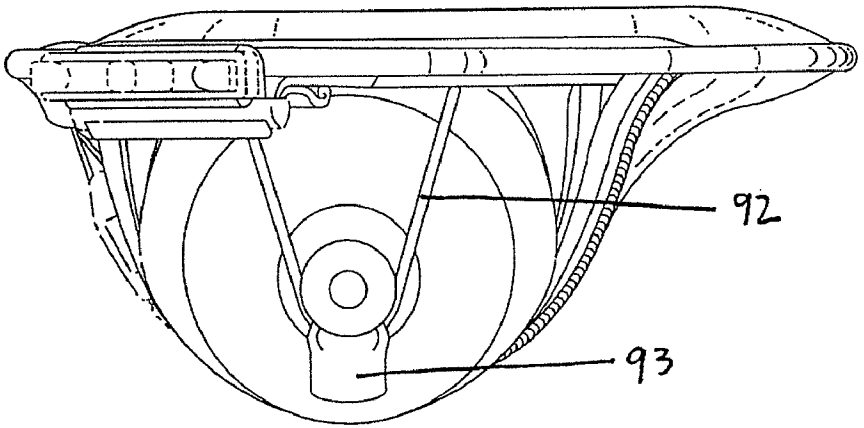
FIG. 19 shows a right end view of a pack with a bottle inside with a bottle nipple retaining elastic cord with tab of the present invention.
Figure 20:
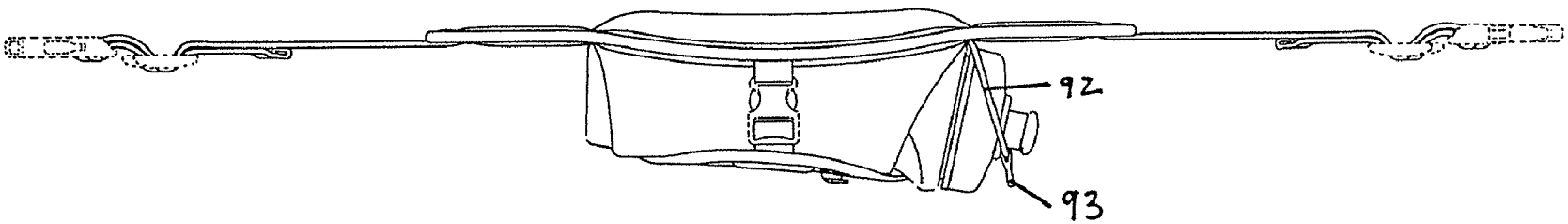
FIG. 20 shows a top view of a pack and components of FIG. 19 of the present invention.

Another embodiment of the pack includes an optional bottle-retaining strap 92, as shown in FIGS. 19, 20 and 21, made of stretch strap/cord/bungee strap or the like with an integrated grab tab 93 also shown in FIGS. 19, 20 and 21. FIGS. 19 and 20 show strap 93 in its bottle retaining engage position. FIG. 21 shows strap 93 in a resting flat biased (to the pack panel) position. This strap is preferable for bottle packs that are intended to be used during activities that are very jarring. This loop like strap is designed to engage with the bottle pull spout or around the bottle neck or other feature on the bottle to provide additional security for holding the bottle into the main pack-retaining sleeve firmly. The strap is fastened at both ends to the bottom face at the opening of the bottle-retaining sleeve as shown in the figures included and preferably originates at points somewhat behind the bottle although it could be attached or positioned at any point around the sleeve opening, providing suitable length and tension to retain the bottle, although not preferable. The strap then can be pulled up and over the bottle spout to firmly hold the bottle in place in the pack (as shown in FIGS. 19 and 20). The strap length is appropriate to engage a portion of the bottle or bottle cap, but sized not so large that the whole bottle can pass through this loop like element. The bottle retaining strap is preferably sewn in such a way that it is biased flat against the pack as shown in FIG. 21 so that when it is not engaged with the bottle spout or other bottle engagement means it lies flat against the pack and does not get in the way of putting the bottle in and out of the pack. This biasing can be easily accomplished by sewing the stretch strap flat against the pack, to begin with, so that it wants to lay in this position when not in use as engaged with the bottle spout. A construction method of assembling this strap into the pack is described in the assembly procedures included. Although there are many other ways a strap for this purpose could be assembled into a similar pack. Some other examples of ways to accomplish a strap providing the same or similar bottle securing means are using a circular band (like an elastic hair band for holding a pony tail) tacked to the pack with stitching, glue, grommeting, etc. Attaching it in a different position around the opening of the main bottle-retaining sleeve. Although it is not preferable it could be attached anywhere around the sleeve, sewn grouted, glued, etc. For example it could be sewn to the front of the sleeve and stretch down over the bottle to secure the bottle in the bottle-retaining sleeve. It can also be threaded, tied or otherwise fastened to itself in a loop, or crimped together end to end and then attached to the pack through a fabric loop retaining loop, or sewn down directly and the like. Also other grab tab elements could be incorporated into the strap to facilitate pulling/grabbing the strap and stretching it in place over the bottle neck or pull spout. This retaining strap and grip element could be incorporated into one rubber or rubber-like element (one piece) so that this rubber strap could be sewn in place and you would get the same bottle retaining means integrated into one piece. Although the preferred type of tab is shown in parts overview drawings (part #9*b*). The tab is preferably a rubber-molded part that the elastic cord #10*b* is threaded through and enclosed tube or hole in the grab tab part.

Added comfort of cantilevered foam elements (transition all the way around bottle eliminates pressure points/areas.) As disclosed and depicted in the shown preferred embodiment the pack is configured in such a way that the bottle retaining element attached to the somewhat flat back panel is positioned somewhat in the middle of this panel and there is somewhat of a cantilever (or extension of the materials of the back panel) of foam or foam-like material that extends outward in all directions around the bottle retaining element (where the bottle is intended be housed.) This cantilevered element is constructed of foam or foam-like material (like wetsuit foam, aerospacer or Drilex or other similar padded, breathable material, polyurethane foam or other similar foam that is used in roll-up mattress or similar pads, or a combination of materials that produce the desired result of producing a padded and somewhat structurally bearing, load distributing effect). This geometry distributes the weight further of the load of the bottle and the elements carried in the pack so that the weight of these elements is carried more comfortably. Producing a more evenly distributed force on the user's body instead of a more pointed load.

Triangular or other shaped pocket which provides for a versatile no bounce extra personal item pocket (or the like holding space). In addition as disclosed the invention preferably also has a piece of fabric or fabric-like portion that extends from the bottom of the lower cantilevered area of the back panel portion of the pack. This fabric or fabric-like element extends upward and is held in place with a strap or somewhat strap-like element (adjustable or not). This element fastened along its bottom edge to the lower cantilevered portion of the pack can be held in place upward with a strap which is attached to an unclaspable buckle or adjustable ring(s) element(s) that allows this area to be unclasped so that the user can access the pocket that is formed in the space between the fabric element and the bottle retaining portion of the pack. This pocket formed in this manner can be made more versatile and more pocket-like if the lower area of the cantilevered portion of the back panel is extended downward locally in a convex or somewhat convex fashion (directly below or somewhat directly below the bottle retaining element). Different packs with different carrying capacities can be made in this manner by varying the size and shape of this protruding portion. Also, another panel or panels can be added to the upwardly extending element that forms a pocket with the bottle retainer so that multiple or larger pockets or substantially pocket-like elements can be made on this element. These panels or formed elements can have closure means provided by such things as zippers, snaps, Velcro, and a host of other readily available fasteners and other techniques of producing closure means for products of this nature. Although not preferable this panel may be eliminated for a pack that needs less storage space (if step 3ii is eliminated in the final assembly of the pack documentation included). In which case the bottle retention sleeve would be clearly visible looking straight at the pack.

This pocket(s) formed in this manner is provided with a minimal of "real estate" on the pack and take advantage of existing geometry to provide more benefits to the user (in the form of more carrying space/pockets or pocket-like elements). In other words this already cantilevered portion of the pack can be used to provide carrying space as well as the foam or foam-like material that this cantilever is constructed of shields the user from feeling the elements being carried (provides cushion between the user and the items being carried). The preferred embodiment as outlined in the drawings included shows two well-defined pocket areas (one accessed by unclasping the central small buckle and one accessed by opening the zipper which opens the space between the two sewn together (at the edges) panels).

Another feature of the disclosed pack is the strap or strap like element or just a portion of fabric that extend from the bottom cantilevered portion of the pack sleeve (if the strap is eliminated and this feature extends upward and connects directly to the top cantilevered portion of the back panel). This element can be configured in such a way that it is in tension and thus pulls on the bottom and top cantilevered portion of the back panel. This tension (accomplished by just making this part short so that it applies tension to these cantilevered elements or also by making the part able to be shortened with a adjusting element like an adjustable buckle or buckle-like element). This tension not only helps to secure the elements being carrying in this pocket (from bouncing and jingling) but can provide more tension in the middle to hold the bottle in the bottle holding element. And, can be shortened in such a way to pull both the top and bottom cantilevered portions of the pack away from the user's body which brings the edges/seams of the pack in these areas away from the body and provide a more comfortable transition to the body in this area.

Yet another benefit of this upwardly extended panel (which extends from the lower portion of the lower cantilevered portion of the back panel) is that it provides secondary retention for holding the bottle into the pack. This feature does this in at least two ways. One it can be configured in such a way to exert pressure in the central area of the bottle retainer element and thus holding the bottle more firmly in the pack. And, two the right-most and/or left-most edge can extend over the side and cover the bottle slightly and the tension in this element pushes and conforms over the convex surface of the bottle to help further retain the bottle in the pack. The more the overhang (on the side the bottle would be removed from the pack) of this panel the more it acts as a retaining feature for the bottle. And thus this panel's size and shape can be adjusted to meet the retaining requirements for the bottle.

In the preferred embodiment this bottle holding element is held to the user's body with straps attached at opposite sides (although many other means of attaching to the body could be used like suspender-type clips integrated into the bottle holding element and constructed in such a way to engage with the user's clothing in a very secure manner, as well as Velcro attachments, buttons, zippers etc made to engage with the user's clothing). These straps or strap-like elements could be integrated in such a way that they really are extensions of the bottle holding element and these extensions could fasten together with a variety of methods including buckles, Velcro, buttons, loops, hooks etc. and adjust to different body sizes using a number of strap adjustment means common to the backpack and worn bag industry. Also, these straps could potentially be one continuous part and the pack could be put on like a pair of pants and buckled to the user's waist, back etc or the straps could be somewhat stretchy (like the waistband of a pair of pants) so that the user could stretch the pack and put it on like a pair of stretch pants.

The means of constructing and assembling the elements—parts/pattern pieces and components of the preferred embodiment of the carrying pack are shown/detailed in two pages of detailed assembly "Assembly Drawings" and two pages of pattern pieces labeled "Parts Overview" disclosed in the above referenced Provisional Patent Applications—allowing anyone versed in the art to easily follow to produce and construct the above detailed pack, bottle and all parts and elements. The pack is sewn together in the manner described and shown using traditional sewing machinery, or can be alternately made using gluing, grommeting, molding etc. The pack and its parts are constructed using varying combinations of common soft, breathable flexible and hardened materials, such as foam nylon, polyester, natural fiber materials such as cotton. The pack and bottle described above, may also obviously be constructed combining components and parts using fewer pieces by combining elements of similar materials (depending upon determining variables like user conditions, needs and cost) or adding additional pieces in construction. Alternative fastening and construction methods may be used such as injection molding of certain elements of the pack such as the bottle sleeve and its attachment to the belt or the user and other components.

Figure 12:
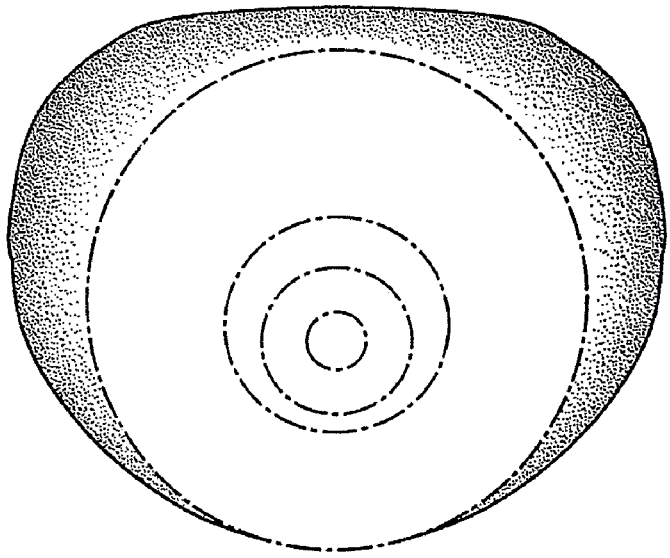
FIG. 12 shows a top view of a bottle cap on a bottle of the present invention.

Bottle/Container Description:

The preferred embodiment of the Bottle/Container described is shown from all perspectives in FIGS. 4, 7, 8, and 9, 10, 11, 12 and is preferably constructed to contain water or other liquid elements for personal hydration purposes (for user to drink from) for a variety of leisure and sport activities although obviously it could be used to contain other fluids or other materials that are able to be contained in a bottle-like container. Preferably the bottle 6, shown front view in FIG. 4, consists of at the minimum, two parts, a container or reservoir portion 50 (FIG. 4) to hold liquid and top 49 (FIG. 4) which is removable and allows for easy drinking of the liquid (although the bottle could obviously be molded integral with the cap attached by a molded-in cord-like element and a "pop-of" type cap could be utilized. Preferably the top includes a push pull drinking spout or other commonly available, effective means of sipping and sealing the container. The top is preferably made using a urethane PE, PU or PP (polypropylene) and is durable, hard and may have a thicker wall thickness than the bottle—as the top is not preferably intended to be squeezable. The bottle/container is preferably made of a durable, but flexible plastic or polymer such as Polyethylene (PE), Polyurethane (PU) or Polypropylene (varying densities or combinations of polymers) to arrive at the desired thickness and flexibility depending upon the final intended use and environment. One combination would be Low Density Poly Ethylene (LDPE) in combination with HDPE or High Density Polyethylene or the like. These materials are desirable for their translucency, flexibility, food grade approval (FDA), ability to be molded easily, readily available and can be made easily and cheaply in different colors, durability, easy to grip or hold on to (not too slippery) and readily available and affordable for molding and manufacture throughout the world. Other materials with these qualities in full or in part are acceptable based upon final use of bottle/container. The body/reservoir of the bottle 50, shown in FIG. 4 is preferably hollow and has a wall thickness in the range of roughly 0.25 mm to 2 mm thick—preferably 1 mm optimizing weight factors, durability, translucency and flexibility among other factors. The preferred general shape/geometry is clearly shown in FIGS. 4, 7, 8, 9, 10, 11 and 12)—shown roughly 100% scale but should be sized as needed based upon the needs of the user/activity. In the preferred embodiment the body is of a low profile (lower as compared and relative to a round cross section type standard sports water bottle readily available at sport shops.) The preferred low profile nature of the bottle's geometry is shown in the side and angled views of the bottle in FIG. 9 and FIGS. 7 and 8. In addition to the low profile overall geometry of the bottle body, the bottle body 50 includes preferred and desirable contours or finger, hand holds to enable the user to easily grasp and to hold the bottle and to easily pull it out of the pack sleeve. The following contours of the bottle are preferred: the central contours 54 are clearly shown in FIG. 4. Additional contours 55, 56, 57, shown in FIGS. 7, 8 and 9. The bottle is preferably held such that a (range of) standard sized human hand places the thumb into contour 55 (this concave contour also engages the constricting element in the bottle sleeve of the pack or formed protrusion, to retain the bottle in the sleeve), and the three or four remaining fingers (wrapping around to the backside of the bottle) pressing the fingertips into one of the channels provided in contour 56 (depending on the length between one's thumb and fingers). Contour 57 shown in FIG. 7 from a somewhat front view, and FIG. 9 from a side view is intended to provide a "pull type" gripping ledge when the bottle is inside the pack sleeve. This geometry aids in easily grasping and pulling/retrieving the bottle out and helps also in orienting for the easy replacement of the bottle into the provided opening in the pack sleeve, on the pack. This embodiment of the bottle is sized to hold about 20 ounces of liquid, but may be proportionately or otherwise scaled as necessary for the specific use or application. The slow sloping contour 58, shown in FIG. 9, and a bottom view 59 shown in FIG. 12, is intended to mate with the corresponding lateral and horizontal contours of the human lower back when the bottle in inserted horizontally (at its length) into the bottle sleeve on the pack as shown in FIG. 1 (bottle nesting in desired position in pack). In this preferred inserted (in pack) bottle position, the back of the bottle's full length lays directly against the persons back inside the lower back horizontal channel as shown from a side view in FIG. 13. The back side (or back surface) of the bottle (the part that should lay against the users back horizontally is shown in 58 (FIG. 9) and 59 (FIG. 11), and also in FIG. 13. The bottle's front side surface labeled 80 shown from the bottom view in FIG. 11, and the side view shown with contour 55 in FIG. 9, and 80 in FIG. 13 faces outward (away from the users body) when the pack is affixed in the preferred position to the user, and the bottle is inserted into the pack sleeve.

The bottle is preferably constructed using blow, vacuum or injection molding process for cost effectiveness, quality, consistency between bottle units, and ease of mass production. The cap is preferably injection molded.

From the description above a number of advantages of our bottle, container, or fluid carrying pack, and/or bottle/container or fluid holding device become evident: Reverses.

The Pack/Bottle provides more overall user comfort.

Pack/Bottle will reduce or eliminate bouncing and chafing due to the jostling/jarring nature of running and similar activities (as experienced with alternative bottle packs).

Pack and bottle optimize the physics of mass in positioning and carrying the weight of water and a fluid container.

The contoured bottle/pack and bottle alone, fits/integrates better and more comfortably in a lateral position in the small of the lower back (versus vertically or angled).

The bottle/pack positions the bottle and its weight and eliminates bottle rotational torsion in bouncing or jostling activities by putting the long axis of the bottle in line with the long axis of the pack waist straps or attachment to the user.

The low profile nature of the bottle/pack provides more comfortable physics relative to the center of mass.

The pack/bottle is easier to use as the bottle can be pulled out directly straight to the side, not requiring the user to pull up (awkwardly and uncomfortably behind the back).

The pack/bottle provide a more optimal weight symmetry, other designs are asymmetrical to the body's vertical center line.

The angle of the waist straps defined at their insertion points to the strap provide for a better fit, and less slippage (upward) and bouncing of the pack or bottle.

The cushioning elements provide more comfort and better fit.

One or more of the pockets for carrying extra items (like keys) provide a poke-proof barrier between the item contained (like keys) and the user's body.

The cool and breathable fabrics, especially in body contact areas, and minimalist footprint of the pack provide for less sweat trapped and a cooler more comfortable user experience.

The low amount of contact area between the bottle and the body (versus a bladder pack) provides for less sweat and more comfort.

The low profile nature of the bottle eliminates and reduces sloshing (sound and movement) of water when water level is lower and make it more comfortable to hold.

The presence of the finger holds and molded contours of the bottle make it easier to hold, find, and retrieve (from pack) for a range of hand sizes.

The bottle is leak free and the presence of its angled neck allow the user to drink without leaning their head/neck back as with a standard straight necked water bottle.

The presence of the internal pack sleeve features allow the bottle to stay in while in use during standard somewhat vertical user positions such as running or other jostling activities, but still allow it to be easy to retrieve and replace and does not require the user to take any extra step of ensuring that the bottle stay inside the sleeve.

The presence of the elastic pack nipple strap provides that the bottle will stay in under just about any use condition.

The presence of the internal constricting pack sleeve or hourglass style geometry which engage with the mating center curve of the bottle allow the user, when inserting the bottle into the sleeve to "feel" when it is properly in place due to the change in pressure when the mating central curves meet.

The geometry and features provide that the bottle may be removed from the pack with one hand.

The presence of the accessible extra, re-closeable pockets, provide ample room for, and easy access to, extra items needed to carry on the user.

The geometry of the pockets and their attachment provide more versatile storage.

The bottle is more hygienic and easy to clean, and can fit standard size ice cubes.

The bottle/pack can conveniently hold other standard round cross section water bottles of similar volume holding capacity or grocery store bought bottles in a range of sizes.

Easy, cost efficient and simple to manufacture with standard equipment for anyone versed in the art.

Uses commonly available materials and processes.

Operation:

The manner of using the Pack/Bottle and the components is similar to that of single and multiple bottle packs for running and sports in present use. Namely, one first holds the pack and pulls out the bottle. The bottle may be filled with any fluid by unscrewing the cap and filling the bottle with the desired fluid, such as water. The cap may be then screwed down and closed tightly. The bottle may be then inserted into the bottle sleeve portion of the pack through the opening, or the bottle can be inserted after the pack is affixed to the user's body. The bottle should be inserted, base or bottom of the bottle in first—leading in, with the neck, cap and nipple or drinking features protruding from the side opening of the pack sleeve). (FIG. 13 shows the preferred orientation of the bottle inside the pack; however it may be turned over and worn comfortably as well.) To put on the pack, the user unclasps the waist straps, if clasped, by disengaging the mated buckle. Holding one strap in one hand the user can swing, or wrap one waist strap around the body laying the pack portion of the article against the small of the users back, with the flat panel of the pack portion against the users back. By bringing the other waist strap around and clasping the two waist strap portions together with the buckle one can affix the pack. Then adjustments to the size of the waist strap may be made by sliding the strap adjusting elements, 37 and 38 in FIG. 1, and feeding the waist strap through these adjusting buckles to achieve the desired strap tightness and pack fit. It is recommended that the pack be worn snugly and adjusted as to fit comfortably in the small of the users back (with the long axis of the bottle laying in the pack along the long horizontal groove of the lower human back. It can also be worn comfortably on or above the buttocks, but lower on the waist. As needed, the user may reach around their body with the right hand, if the bottle sleeve opening is situated on the right side (facing the rear of the person) and grasp the neck, cap or grabbing ledge protrusion contour portion of the bottle and pulling the bottle out. Pulling up on the pop top nipple of the bottle and holding the bottle high above the mouth allows the user to squirt water into their mouth, or draw water (as from a straw) into the mouth from the bottle. The pop top nipple is then press down upon to close (as to not leak while in use) and re-inserted back into the bottle sleeve in exactly the reverse of how it was originally removed.

Accordingly the reader will see that there are a number of advantages of the preferred Bottle/Pack and Bottle of this invention which make it more comfortable to carry a bottle and its contents, easier and more comfortable to retrieve and replace the bottle relative to the pack, and keeps the bottle securely in the pack while still allowing easy and superior access and retrieval of it.

Although the description above contains much specificity, these should not be construed as limiting the scope of the invention, but merely providing illustrations of some of the presently preferred embodiments of this invention. For example, the bottle retaining sleeve may utilize internal constricting elements or sewing to achieve its optimal bottle retainment geometry, etc.

Thus the scope of the invention should be determined by the appended claims and their legal equivalents, rather than by examples given.

We claim:

1. A waist pack, comprising:

a bottle having a base, an upper end with a mouth, a central axis, and a diameter about the central axis, the bottle further being sufficiently rigid that it substantially retains its shape when full or empty;

a first waist panel formed from at least one layer of material, the first waist panel having a front side, a back side, a top, a bottom, a first end, and a second end;

a second waist panel formed from at least one swatch of material having a front side, a back side, a top, a bottom, a first end, and a second end, the second waist panel being attached to the first waist panel to form a first opening at the first end of the second waist panel and a second opening at the second end of the second waist panel, each of the first and second openings being sized to allow the bottle to fully pass through, whereby the bottle is retained between the first waist panel and the second waist panel with the central axis of the bottle extending in a direction generally from the first opening to the second opening;

the attachment of the first waist panel to the second waist panel further forming a bottom attachment border along the bottom of the second waist panel, the bottom attachment border following a path that is relatively closer to the top of the first waist panel adjacent the first end of the second waist panel and becoming relatively more distant from the top of the first waist panel for an initial distance from the first end toward the second end of the second waist panel, the bottom attachment border further following a path that is relatively closer to the top of the first waist panel adjacent the second end of the second waist panel and becoming relatively more distant from the top of the first waist panel for an initial distance from the second end toward the first end of the second waist panel;

a first belt section extending from the first waist panel at a first connection point, the first belt section having a distal end;

a second belt section extending from the first waist panel at a second connection point, the second belt section having a distal end;

whereby the bottle is retained between the first waist panel and the second waist panel with the central axis of the bottle being parallel to a line extending from the first connection point to the second connection point; and the first and second belt sections each having a mating fastener, wherein the waist pack may be secured about the waist of a user by joining the mating fasteners.

2. The waist pack of claim 1, wherein the second waist panel is further shaped and attached to the first waist panel such that the first end of the second waist panel forms an arcuate path from the first end of the second waist panel to the top of the second waist panel, and the second waist panel is shaped and attached to the first waist panel such that the second end of the second waist panel forms an arcuate path from the second end of the second waist panel to the top of the second waist panel.

3. The waist pack of claim 1 wherein the second waist panel further comprises a middle generally between the top and the bottom, and wherein the bottom of the second waist panel at the first opening extends laterally beyond the middle of the second waist panel at the first opening, and further wherein the bottom of the second waist panel at the second opening extends laterally beyond the middle of the second waist panel at the second opening.

4. The waist pack of claim 3, wherein the second waist panel further comprises a midpoint between the first end and the second end, wherein the second waist panel is symmetrical about the midpoint.

5. The waist pack of claim 1 wherein the second waist panel in combination with the first waist panel forms a first cupped region at the first end of the second waist panel and a second cupped region at the second of the second waist panel.

6. The waist pack of claim 1 wherein the waist pack has a top adjacent the top of the first and second waist panels and a bottom adjacent the bottom of the first and second waist panels and further wherein the second waist panel is shaped and attached to the first waist panel such that the first end of the second waist panel forms a first arcuate path comprising the first opening, and the second waist panel further being shaped and attached to the first waist panel such that the second end of the second waist panel forms a second arcuate path comprising the second opening, both the first and the second openings being canted toward the top of the waist pack.

7. A waist pack, comprising:

a bottle having a base, an upper end with a mouth, a central axis, and a diameter about the central axis, the bottle further being sufficiently rigid that it substantially retains its shape when full or empty;

a first waist panel formed from at least one layer of material, the first waist panel having a front side, a back side, a top, a bottom, a first end, and a second end;

a second waist panel formed from at least one swatch of material having a front side, a back side, a top, a bottom, a first end, and a second end, the bottom of the second waist panel being attached adjacent the bottom of the first waist panel along a bottom attachment border, the bottom attachment border following a path that is relatively closer to the top of the first waist panel adjacent each of the first and second ends and becoming relatively more distant from the top of the first waist panel for an initial distance along the bottom attachment border from the second end of the second waist panel toward the first end of the second waist panel and also from the first end of the second waist panel toward the second end of the second waist panel wherein the second waist panel in combination with the first waist panel forms a first cupped region at the first end of the second waist panel and a second cupped region at the second end of the second waist panel for retaining the bottle, further, the top of the second waist panel being connected adjacent the top of the first waist panel to define a first opening at the first end of the second waist panel and a second opening at the second end of the second waist panel, each of the first and second openings being sized to allow the bottle to fully pass through, whereby the bottle is retained between the first waist panel and the second waist panel;

a first belt section extending from the first end of the first waist panel, the first belt section having a distal end;

a second belt section extending from the second end of the first waist panel, the second belt section having a distal end; and the first and second belt sections each having a mating fastener, wherein the waist pack may be secured about the waist of a user by joining the mating fasteners.

8. The waist pack of claim 7 wherein the first belt section is connected to the first waist panel adjacent the first end of the first waist panel at a first belt connection, and the second belt section is connected to the first waist panel adjacent the second end of the first waist panel at a second belt connection, the central axis of the bottle being parallel to a line connecting the first belt connection to the second belt connection.

9. The waist pack of claim 7 wherein the second waist panel further comprises a middle generally between the top and the bottom, and wherein the bottom of the second waist panel at the first opening extends laterally beyond the middle of the second waist panel at the first opening, and further wherein the bottom of the second waist panel at the second opening extends laterally beyond the middle of the second waist panel at the second opening.

10. The waist pack of claim 9, wherein the second waist panel further comprises a midpoint between the first end and the second end, wherein the second waist panel is symmetrical about the midpoint.

11. The waist pack of claim 7 wherein the second waist panel further being shaped and attached to the first waist panel such that the first end of the second waist panel forms an arcuate path from the first end of the second waist panel to the top of the second waist panel; and, the second waist panel further being shaped and attached to the first waist panel such that the second end of the second waist panel forms an arcuate path from the second end of the second waist panel to the top of the second waist panel.

* * * * *